US007372440B2

(12) United States Patent
Ota et al.

(10) Patent No.: US 7,372,440 B2
(45) Date of Patent: May 13, 2008

(54) ACTIVE MATRIX DISPLAY DEVICE

(75) Inventors: Masuyuki Ota, Matto (JP); Yoshiro Aoki, Kitamoto (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 303 days.

(21) Appl. No.: 11/270,695

(22) Filed: Nov. 10, 2005

(65) Prior Publication Data

US 2006/0066536 A1 Mar. 30, 2006

Related U.S. Application Data

(63) Continuation of application No. PCT/JP2004/006705, filed on May 12, 2004.

(30) Foreign Application Priority Data

May 13, 2003 (JP) ..... 2003-134348
Nov. 7, 2003 (JP) ..... 2003-378978

(51) Int. Cl.
*G09G 3/30* (2006.01)

(52) U.S. Cl. ..... 345/76

(58) Field of Classification Search ..... 345/76–86, 345/211–213, 690–693, 87–92; 315/169.1–169.3
See application file for complete search history.

(56) References Cited

U.S. PATENT DOCUMENTS 6,229,506 B1 5/2001 Dawson et al. ..... 345/82
6,373,454 B1 4/2002 Knapp et al. ..... 345/76
6,753,654 B2 * 6/2004 Koyama ..... 315/169.1
6,798,148 B2 * 9/2004 Inukai ..... 315/169.3
6,870,553 B2 * 3/2005 Kondo et al. ..... 345/690
6,903,731 B2 * 6/2005 Inukai ..... 345/204
7,009,590 B2 * 3/2006 Numao ..... 345/76

(Continued)

FOREIGN PATENT DOCUMENTS

CN 1402212 A 3/2003

(Continued)

OTHER PUBLICATIONS

M. Shimoda, et al., "New Pixel-Driving Scheme with Data-Line Pre-Charge Function for Active Matrix Organic Light Emitting Diode Displays", Proceedings of the Ninth International Display Workshops, IDW '02, Dec. 4-6, 2002, pp. 239-242.

*Primary Examiner*—Sumati Lefkowitz
*Assistant Examiner*—Rodney Amadiz
(74) *Attorney, Agent, or Firm*—Oblon, Spivak, McClelland, Maier & Neustadt, P.C.

(57) ABSTRACT

An active matrix display device comprises a plurality of pixels which are arranged in the form of a matrix on a substrate and each of which includes a display element and a pixel circuit which supplies the display element with a drive current, video signal lines arranged along the pixels, and a video signal driver which, after the supply of base currents to the video signal lines, supplies the pixels with gradation currents through the video signal lines. The pixel circuit includes a pixel switch which controls whether or not to select the pixel, stores the difference current between the gradation and base currents when the pixel is selected and outputs the stored difference current to the display element as the drive current when the pixel is nonselected.

17 Claims, 20 Drawing Sheets

U.S. PATENT DOCUMENTS

| | | | | |
|---|---|---|---|---|
| 7,061,451 | B2 * | 6/2006 | Kimura | 345/76 |
| 7,113,154 | B1 * | 9/2006 | Inukai | 345/76 |
| 2002/0195964 | A1 | 12/2002 | Yumoto | |
| 2003/0016191 | A1 | 1/2003 | Nakamura et al. | |
| 2003/0030382 | A1 | 2/2003 | Koyama | |
| 2003/0103022 | A1 * | 6/2003 | Noguchi et al. | 345/77 |
| 2003/0142509 | A1 * | 7/2003 | Tsuchiya et al. | 362/555 |
| 2005/0030304 | A1 * | 2/2005 | Inukai | 345/204 |
| 2006/0145960 | A1 * | 7/2006 | Koga et al. | 345/76 |

FOREIGN PATENT DOCUMENTS

| | | |
|---|---|---|
| EP | 1 130 565 A1 | 9/2001 |
| JP | 3-237434 | 10/1991 |
| JP | 8-123373 | 5/1996 |
| JP | 2003-108066 | 4/2003 |
| JP | 2003-150116 | 5/2005 |
| WO | WO 01/06484 | 1/2001 |
| WO | WO 03/091980 | 11/2003 |

* cited by examiner (A) Write operation time (B) Display operation time

ACTIVE MATRIX DISPLAY DEVICE

CROSS-REFERENCE TO RELATED APPLICATIONS

This is a Continuation Application of PCT Application No. PCT/JP2004/006705, filed May 12, 2004, which was published under PCT Article 21(2) in Japanese.

This application is based upon and claims the benefit of priority from prior Japanese Patent Applications No. 2003-134348, filed May 13, 2003; and No. 2003-378978, filed Nov. 7, 2003, the entire contents of both of which are incorporated herein by reference.

BACKGROUND OF THE INVENTION

1. Field of the Invention

The present invention relates to an active matrix display device and more specifically to an active matrix display device which performs signal writing through current signals.

2. Description of the Related Art

In contrast to CRT displays, flat panel display devices exemplified by liquid crystal display devices are rapidly increasing in demand because of their features of being small in thickness, light in weight, and low in power consumption. Above all, active matrix display devices, in which on pixels are electrically isolated from off pixels and a pixel switch is provided for each pixel which has a function of holding a video signal to it when it is on, have found applications in various displays, including portable information devices, because they offer good display quality with no crosstalk between adjacent pixels.

In recent years, as self-emission type displays which allow the response to be made faster and the angle of visibility to be made wider in comparison with the liquid crystal display devices, organic electroluminescence (EL) display devices have been developed vigorously. The organic EL display device contains an organic EL element as a display element and a pixel circuit adapted to supply a drive current to the display element for each pixel and performs a display operation by controlling emission brightness. As systems for supplying image information to the pixel circuit, a current-signal-based system as disclosed in, for example, U.S. Pat. No. 6,373,454 B1 and a voltage-signal-based system as disclosed in, for example, U.S. Pat. No. 6,229,506 B1 are known.

However, with a display device which performs signal supply through current signals, the capacitance of an interconnect line which performs signal supply may result in failure to perform sufficient signal supply. In particular, when the write current value is small, there arises a problem that display failures occur due to insufficient writing. In addition, for multi-degradation display, difficulties are involved in writing on the low-degradation side where the set amount of current is small, causing display failures to occur.

BRIEF SUMMARY OF THE INVENTION

The present invention is contrived in consideration of the above circumstances, and its object is to provide an active matrix display device which, even with signal supply through current signals, allows a good display operation to be performed.

An active matrix display device according to an aspect of the invention comprises: a plurality of pixels arranged in the form of a matrix on a substrate, each of the pixels including a display element and a pixel circuit which supplies the display element with a drive current; a plurality of first video signal lines and a plurality of second video signal lines arranged along the pixels; and a video signal driver which supplies the pixels with base currents through the first video signal lines and with gradation currents through the second video signal lines, the gradation currents being opposite in the direction of flow to the base currents, the pixel circuit including a first pixel switch connected to a corresponding one of the first video signal lines and a second pixel switch connected to a corresponding one of the second video signal lines, storing the difference current between the gradation current and the base current when the pixel is selected, and outputting the stored difference current as the drive current when the pixel is nonselected.

According to another aspect of the invention, there is provided an active matrix display device comprising: a plurality of display elements arranged in the form of a matrix on a substrate; first and second video signal lines which supply each of the display elements with video signals; a capacitor which holds the video signal for a predetermined period; a transistor having its gate connected to one end of the capacitor and its source connected to the other end of the capacitor; a first switch connected between the gate and drain of the transistor; a first pixel switch connected between the first video signal line and the drain; and a second pixel switch connected between the second video signal line and the drain.

An active matrix display device according to still another aspect of the invention comprises a plurality of pixels arranged in the form of a matrix on a substrate, each of the pixels including a display element and a pixel circuit which supplies the display element with a drive current; video signal lines arranged along the pixels; and a video signal driver which, after the supply of base currents to the video signal lines, supplies the pixels with gradation currents through the video signal lines, the pixel circuit including a pixel switch which controls whether or not to select the pixel, storing the difference current between the gradation current and the base current when the pixel is selected, and outputting the stored difference current to the display element as the drive current when the pixel is nonselected.

An active matrix display device according to another aspect of the invention comprises: a plurality of pixels arranged in the form of a matrix on a substrate, each of the pixels including a display element and a pixel circuit which supplies the display element with a drive current; video signal lines arranged along the pixels; a video signal driver which supplies base currents to the video signal lines and supplies the pixels with gradation currents through the video signal lines; and a base current storage unit which stores the base currents supplied from the video signal driver and outputs them to the video signal lines, the pixel circuit including a pixel switch which controls whether or not to select the pixel, storing the difference current between the gradation and base currents when the pixel is selected, and outputting the stored difference current as the drive current when the pixel is nonselected.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An organic EL display device according to a first embodiment of the present invention will be described in detail below with reference to the drawings.

An example of an active matrix display device of the present invention will be described in detail with reference to the drawings taking an organic EL display device by way of example.

Figure 1:
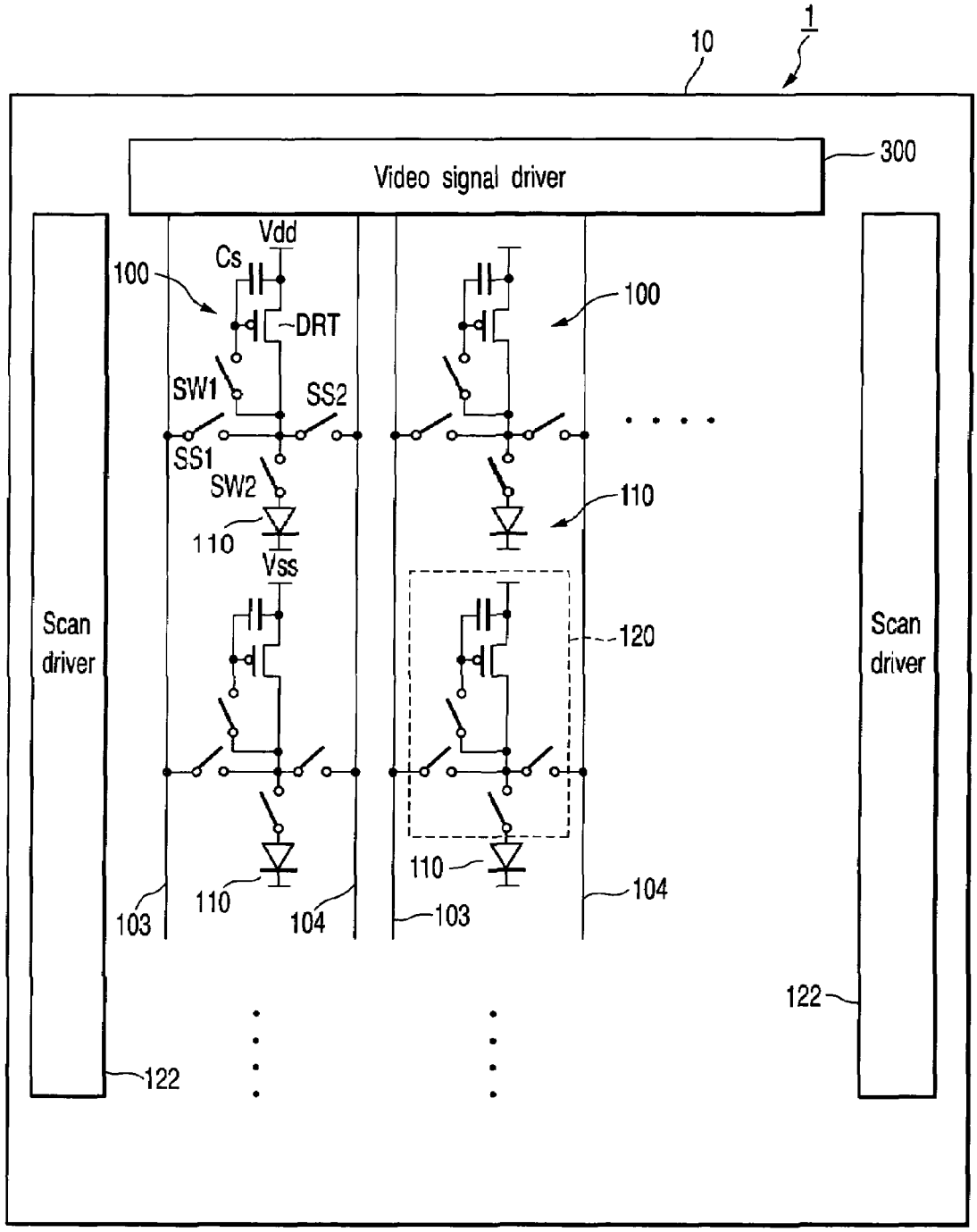
FIG. 1 is a schematic plan view illustrating an organic EL display device according to a first embodiment of the present invention.
Figure 2:
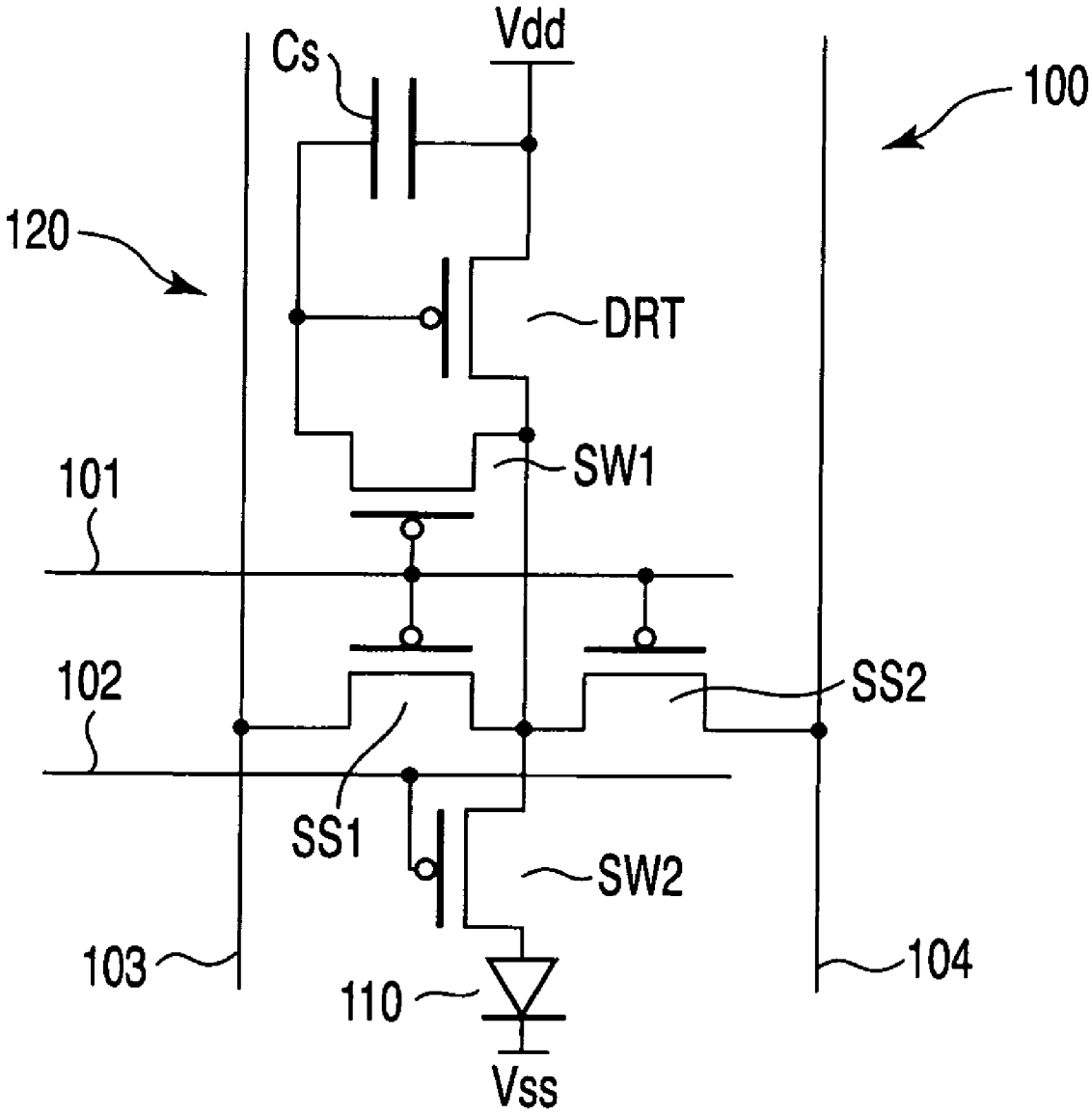
FIG. 2 shows the circuit arrangement of a pixel in the organic EL display device.

FIG. 1 is a schematic plan view of the organic EL display device. FIG. 2 is a partial circuit diagram for one pixel as an example of a pixel in the organic EL display device.

As shown in FIGS. 1 and 2, the organic EL display device 1, which is constructed here as a large active matrix display device of a model of 10 or more in size, includes a plurality of pixels 100 arranged in the form of a matrix on an insulating support plate 10 made of glass or the like, a plurality of scan lines 101 and a plurality of control lines 102 each of which is placed in the row direction of the pixels 100, a plurality of first video signal lines 103 and a plurality of second video signal lines 104 each of which is placed along the column direction of the pixels 100, scan drivers 122 which output scan signals Scana to the scan lines 101 and control signals Scanb to the control lines 102, and a video signal driver 300 which supplies the first video signal lines 103 with base currents Is and the second video signal lines 104 with gradation currents Ic as video signals.

Each of the pixels 100 includes a display element 110 having a light activation layer between opposed electrodes and a pixel circuit 120 which outputs a drive current $I_D$ to drive the display element 110. The display element 110 is, for example, a self-emission element. The display element is here an organic EL element having at least an organic light emission layer as the light emission layer.

The pixel circuit 120 stores the difference current between a gradation current $I_C$ and a base current $I_B$ when the pixel 100 is selected and outputs the stored difference current to the display element 110 as the drive current $I_D$ when the pixel 100 is non-selected. The pixel circuit 120 is provided with a drive transistor DRT consisting of a p-type thin-film transistor and connected in series with the display element 110 between a first voltage power supply Vdd and a second voltage power supply Vss, a capacitor Cs connected between a first terminal (source) and a control terminal (gate) of the drive transistor DRT, a first switch SW1 consisting of a p-type thin-film transistor and connected between a second terminal (drain) and the control terminal of the drive transistor DRT, a second switch SW2 consisting of a p-type thin-film transistor and connected between the second terminal of the drive transistor DRT and a first electrode (here the anode) of the display element 110, a first pixel switch SS1 connected between the second terminal of the drive transistor DRT and a first video signal supply terminal, and a second pixel switch SS2 connected between the second terminal of the drive transistor DRT and a second video signal supply terminal.

The first and second pixel switches SS1 and SS2 are each comprised of a p-type thin-film transistor which is of the same conductivity type as the first switch SW1. The first and second pixel switches SS1 and SS2 are controlled through the same scan line 101. The first switch SW1 is also controlled through the same scan line 101 as the first and second pixel switches SS1 and SS2. That is, a scan line 101 is placed for each row of the pixels 100 and the control terminals of the first and second pixel switches SS1 and SS2 and the first switch SW1 in each row of the pixels 100 are connected to the same scan line 101. The on-off control of the switches is performed on the basis of a scan signal Scana supplied from the scan drivers 122 integrally formed on the support substrate 10.

By making the first and second pixel switches SS1 and SS2 and the first witch SW1 identical in conductivity type, it becomes possible to control them through the same line, allowing an increase in the number of lines to be suppressed. The control terminal of the second switch SW2 is connected to the scan driver 122 through the control line 102 and is subject to on-off control by the control signal Scanb from the scan driver.

In the present embodiment, the thin-film transistors constituting the pixel circuit 120 are all formed through the same manufacturing process into the same layer structure and are thin-film transistors of the top gate structure using polysilicon for semiconductor layers. In addition, an increase in the number of manufacturing steps can be suppressed by constituting the pixel circuit with thin-film transistors which are all identical in conductivity type.

The first and second video signal supply terminals connected through the first and second pixel switches SS1 and SS2 to the second terminal of the drive transistor DRT are respectively connected to the first and second video signal lines 103 and 104 wired in common for each column of the pixels 100 and then connected to the video signal driver 300 as a drive circuit by the video signal lines 103 and 104.

The scan driver 122 includes a shift register and output buffers. The driver transfers an externally applied horizontal scanning start pulse in sequence from one stage to the next and applies the output of each stage through the output buffer to the scan line 101 as the scan signal Scana. This timing is synchronous with one horizontal scan period. In addition, the scan driver 122 processes the output of each stage to produce the control signal Scanb and applies it to the control line 102.

Figure 3:
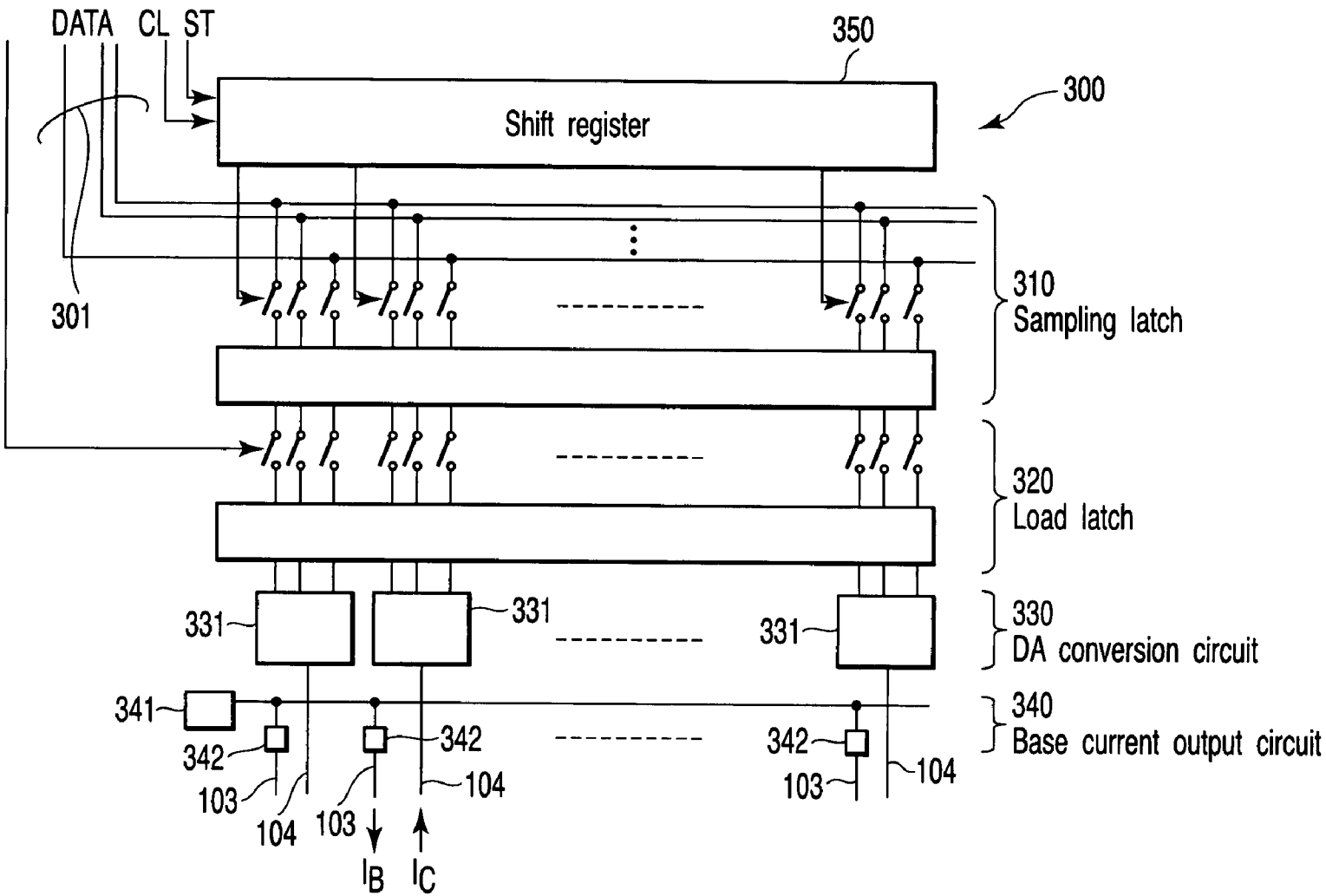
FIG. 3 is a schematic circuit diagram of the video signal driver in the organic EL display device.

The video signal driver 300, as shown in FIG. 3, includes a video line 301 which is connected to receive a digital data signal DATA as a video signal, and a sampling latch circuit 310 which serial-to-parallel converts the data signal DATA on the video line 301, then sequentially outputs it to storage elements each of which corresponds to a respective one of the second video signal lines 104 and holds it in the storage elements. The driver 300 further includes a shift register 350 which controls the operational timing of the sampling latch circuit 310, a load latch circuit 320 which collectively outputs the data signal DATA for one line held in the sampling latch circuit 310 to storage elements each of which corresponds to a respective one of the second video signal lines 104 and holds it during one horizontal scan period, a DA conversion circuit 330 which has DA units 331 each of which corresponds to a respective one of the second video signal lines 104, converts the data signal DATA supplied through the load latch circuit 320 into analog form and outputs it onto the second video signal lines 104 as gradation currents $I_C$, and a base current output circuit 340 which is connected to the first video signal lines 103 and outputs base currents $I_B$. The supplied gradation currents $I_C$ and base currents $I_B$ are opposite to each other in the direction of current flow. The base current output circuit 340 is provided with a plurality of base current output sources 342 each of which forms a current mirror for a constant current source 341 and corresponds to a respective one of the first video signal supply lines 103.

Figure 4:
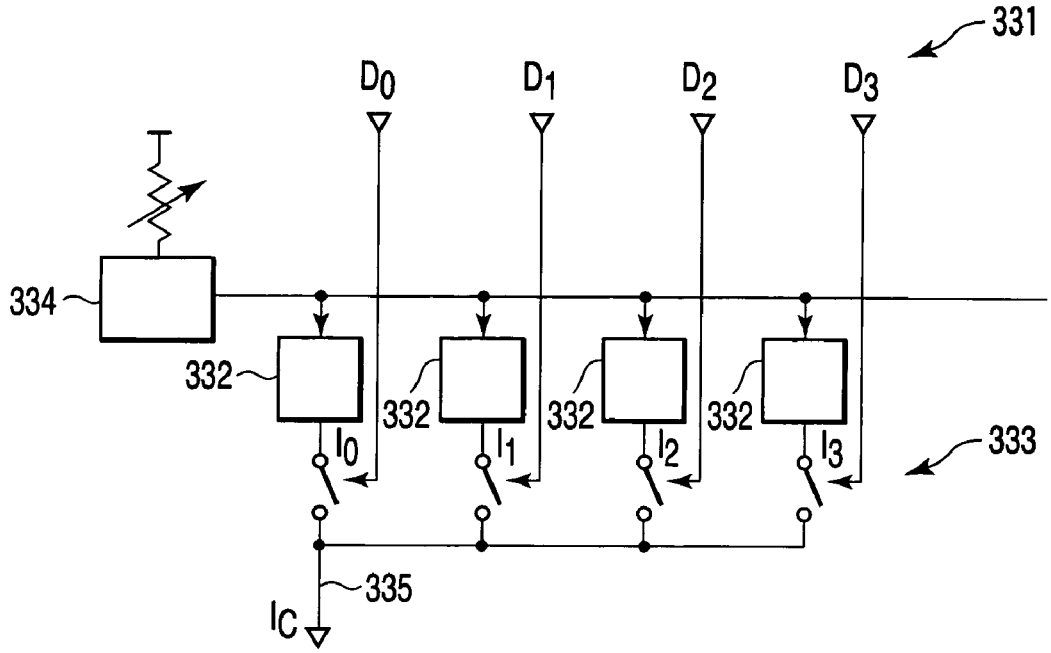
FIG. 4 is a schematic circuit diagram of the DA unit in the organic EL display device.

Each DA unit 331 in the DA conversion circuit 330 is provided, as shown in FIG. 4, with a plurality of gradation reference current sources 332 which form current mirror circuits for a constant current source 334 and output different gradation reference currents I0-I3, a switch circuit 333 which controls whether or not to output the gradation reference currents from the gradation reference current sources 332 in accordance with the data signal DATA (D0-D3), and a gradation current line 335 which connects together the output terminals of the switch circuit 333. The number of the gradation reference current sources 332 corresponds to the number of bits of the data signal DATA. Here, as an example, the case of four bits is illustrated.

Each of the gradation reference current sources 332 is configured to provide n times as much current as the constant current source, and whether this current is to be output or not is controlled by the switch circuit 333 in accordance with the data signal DATA. The total of output currents of the switch circuit 333 flows along the gradation current line 335 as the gradation current IC, which is in turn applied to the corresponding second video signal line 104.

The scan driver 122 and the video signal driver 300 are placed on the same substrate as the display elements 110 and formed simultaneously with the lines and TFTs (thin-film transistors) constituting the pixel circuit 120 with the same manufacturing process. Here, n-type thin-film transistors and p-type thin-film transistors are combined to form the circuits; however, as with the pixel circuit 120, the circuits may be constructed from only p-type thin-film transistors to further reduce the number of manufacturing steps. Thus, by containing the video signal driver 300, the length of the lines that convey current signals can be reduced, resulting in reduced capacitive load and allowing stable current signal supply. In addition, the number of points for connection to external circuits can be reduced, allowing the mechanical reliability to be increased.

Next, the pixel circuit 120 will be described in more detail.

Figure 5A:
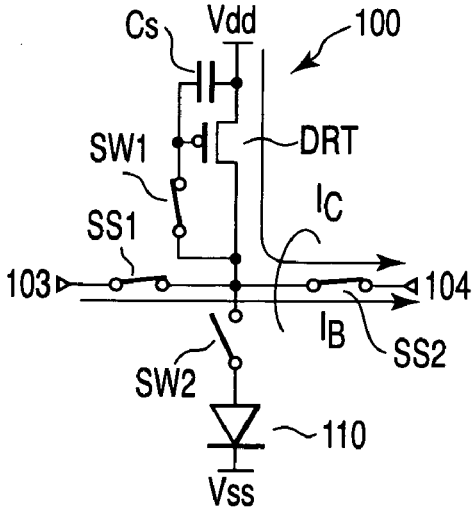
FIGS. 5A and 5B are diagrams for use in explanation of the operation of a pixel in the organic EL display device.
Figure 5B:
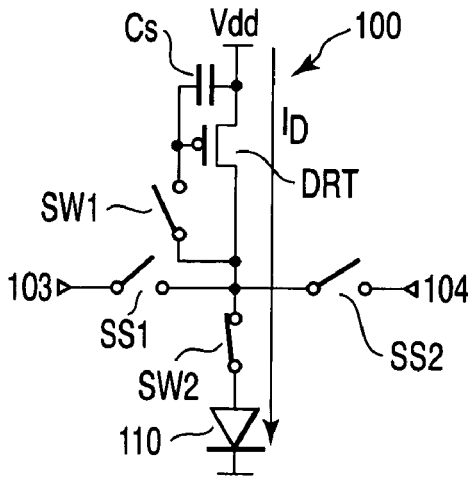
Figure 6:
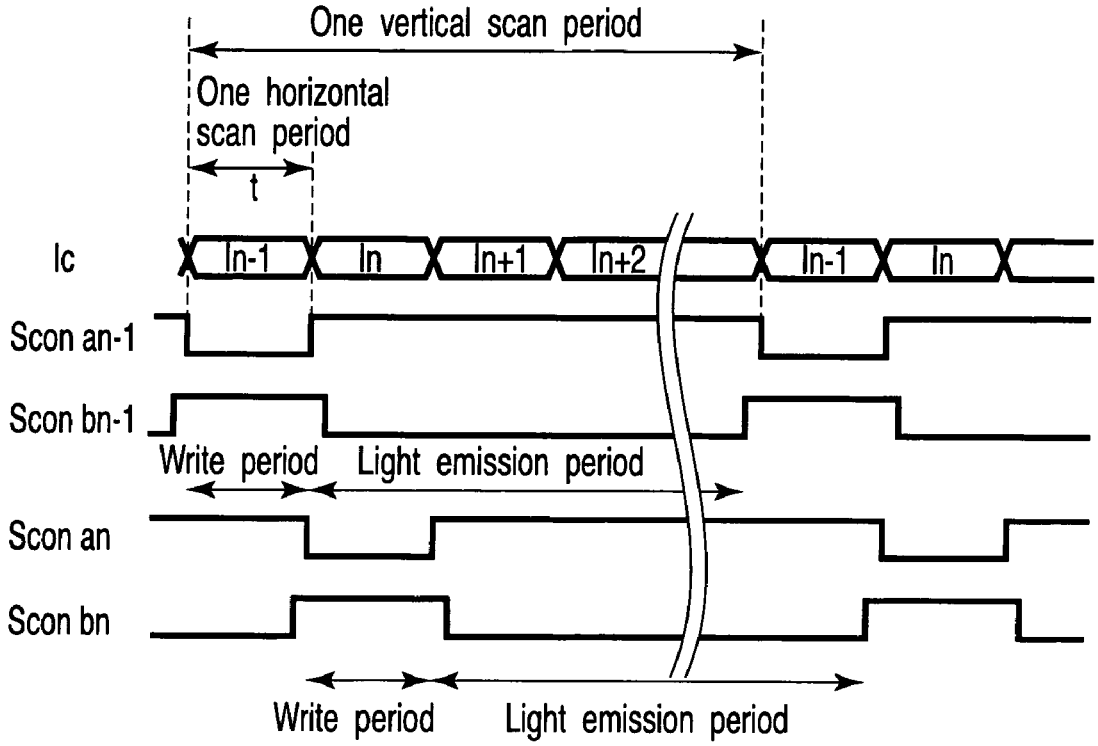
FIG. 6 is a timing chart for pixels in the organic EL display device.

FIG. 5A shows the operation of the pixel circuit 120 at the write time. FIG. 5B shows the operation of the pixel circuit 120 at the display time. FIG. 6 is a timing chart explanatory of the operation of the pixel circuit.

As shown in FIGS. 5A and 6, during the write period, the scan signals Scana are output in sequence from the scan driver 122 for each of the scan lines 101 to place the first and second pixel switches SS1 and SS2 and the first switch SW1 in the on state (conductive state). At this point, the second switch SW2 is placed in the off state (non-conductive state) by the control signal Scanb output onto the control line 102 from the scan driver 122.

The first pixel switches SS1 and the second pixel switches SS2 in the selected row are turned on by the scan signal Scana with the result that writing of a video signal into the pixels 100 is performed by the video signal driver 300. The first pixel switches SS1 and the second pixel switches SS2 in nonselected rows are in the off state and electrically isolated from the pixels 100 in the on state.

The writing of a video signal into the pixels 100 is performed through electrical signal supply from the video signal driver 300 over two paths. One of the paths connects to the pixels 100 through the first video signal line 103 for supply of the base current $I_B$. The other path connects to the pixels 100 through the second signal video line 104 for supply of the gradation currents $I_C$. Here, the base current $I_B$ is a current signal set to a fixed value by the constant current source 341 and set to a value greater than a displacement current required to charge the potential difference $\Delta V$ between the highest gradation display time and the lowest gradation display time ($I_B > Cp \times \Delta V/t$: Cp is the capacitance of the first video signal line, and t is one horizontal scan period). That is, the base current is set to a value greater than the amount of charge per horizontal scan period (t) required to give the potential difference ΔV corresponding to the maximum voltage change to the capacitance (Cp) of the first video signal line 103. For example, the base current is set to a magnitude comparable to the drive current $I_D$ for the highest gradation display. As an example, for full color display, in pixels 100 which emit red light the base current is of the order of 2 μA. The gradation current $I_C$, which is a current signal set such that the amount of current flowing across the source-to-drain path of the drive transistor DRT have a desired magnitude, is set to a magnitude corresponding to the sum of the base current $I_B$ and the drive current $I_D$ supplied to the display element 110. That is, the amount of current flowing across the source-to-drain path of the drive transistor DRT is set to the difference current between the gradation current $I_C$ and the base current $I_B$. Although the base current $I_B$ and the gradation current $I_C$ have been described here as being fixed and variable, respectively, both of them may be made variable. This is set accordingly.

The first switch SW1 is also placed in the on state by the scan signal Scana with the result that the gate and drain of the drive transistor DRT are connected together. Thus, the gate potential of the drive transistor DRT is set according to the written difference current amount.

For example, to make a black display with a voltage change of 3 V, it is only required to set the base current $I_B$ to 2.0 μA and the gradation current $I_C$ to 2.0 μA. Since a current of not less than several microamperes flows through the line connected to each input terminal, even if a capacitance of 10 pF is associated with it, the capacitance can be charged within 15 μs, allowing a stable display operation to be performed without causing the shortage of time required for writing a video signal into the pixel circuits 120.

After that, when the first switch SW1 is placed in the off state in accordance with the scan signal Scana; the gate potential of the drive transistor DRT set according to the video signal is held on the capacitor Cs. In addition, the first and second pixel switches SS1 and SS2 are placed in the off state with the result that the pixel 100 written with the video signal is electrically isolated from the other pixels 100 and holds the video signal for a predetermined period of time.

As shown in FIGS. 5B and 6, in the light emission period following the video signal write period, the second switch SW2 is rendered conductive (on state) by the control signal Scanb applied to the control line 102 with the result that a current of approximately the same magnitude as the drive current $I_D$ flows through the display element 110 as the video signal and the display element 110 emits light at a level corresponding to the input signal.

Thus, since a difference current is used in writing a current corresponding to an input signal representing video information input from an external circuit, the current value applied to a video signal line can be set freely. For this reason, the base current IB and the gradation current ID can be set sufficiently larger than the capacitance of the first and second video signal lines 103 and 104, allowing sufficient signal supply in writing a video signal into pixels.

In writing a video signal into pixels, a large write current which is not affected by line capacitance allows writing with a small current which is its difference current. For this reason, pixels in which the set amount of current is small can be written into well without causing the shortage of writing. Therefore, the visibility of sensations of line-shaped non-uniformity and roughness on the low gradation side can be solved.

Moreover, even in a case where, after writing of a high current into the video signal line has been performed, a low current is written, the shortage of writing of a video signal of low current can be solved. For example, in writing a video signal for the lowest gradation display (black display) after a video signal for the highest gradation display (white display) has been written, the shortage of writing of the former video signal results in a high-gradation-side written state, in which case an image such that a white display leaves traces may be displayed. According to the present embodiment, however, it becomes possible to solve display failures due to such shortage of writing.

From the above, an organic EL display device is obtained which allows a good display operation to be performed even with signal supply based on current signals.

Although the present embodiment has been described as constituting the pixel circuit 120 with thin-film transistors which are all of the same conductivity type, p type in this example, this is not restrictive; that is, all the thin-film transistors may be of n type. Moreover, it is also possible to form the pixel circuit 120 using different conductivity types of thin-film transistors in combination, e.g., by forming the first and second pixel switches SS1 and SS2 and the first switch SW1 from n-type thin-film transistors and the drive transistor DRT and the second switch SW2 from p-type thin-film transistors. The same is true of the drivers.

Although the present embodiment has been described as controlling the first switch SW1 and the first and second pixel switches SS1 and SS2 through the same scan line, it is also possible to control each of them through an independent line.

Figure 7:
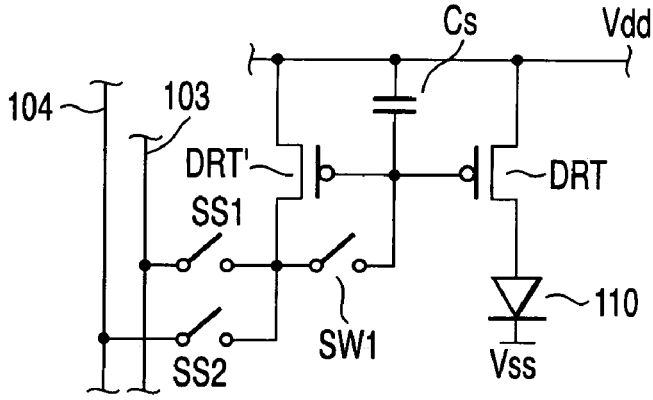
FIG. 7 is a circuit diagram of a pixel according to a modification of the invention.

In the present embodiment, as the pixel circuit 120 use is made of a current copy type circuit in which, when the pixel 100 is selected, the difference current between the gradation current $I_C$ and the base current $I_B$ is stored and, when the pixel 100 is nonselected, the stored current is output to the display element 110 as the drive current $I_D$ for display operation; however, this is not restrictive. For example, as shown in FIG. 7, as the pixel circuit 120 use may be made of a current mirror type circuit which is provided with a transistor DRT' arranged in a current mirror relationship to the drive transistor DRT and in which, when the pixel 100 is selected, the transistor DRT' is used in writing a video signal and, when the pixel 100 is nonselected, a current approximately equal in magnitude to the current written through the transistor DRT' is output through the drive transistor DRT to the display element 110 as the drive current $I_D$. The present invention can be adapted to various types of display devices in which a video signal is written into the pixels 100 through the use of current signals.

Although the present embodiment has been described as providing a plurality of base current output circuits 340 in correspondence with the first video signal lines 103, this is not restrictive. A base current output circuit may be arranged in common to all the first video signal lines 103.

Although the present embodiment has been described as constituting the gradation reference current source and the base current output circuit 340 using a circuit that forms a current mirror with a constant current source, this is not restrictive. A current copy circuit may be used.

Figure 8:
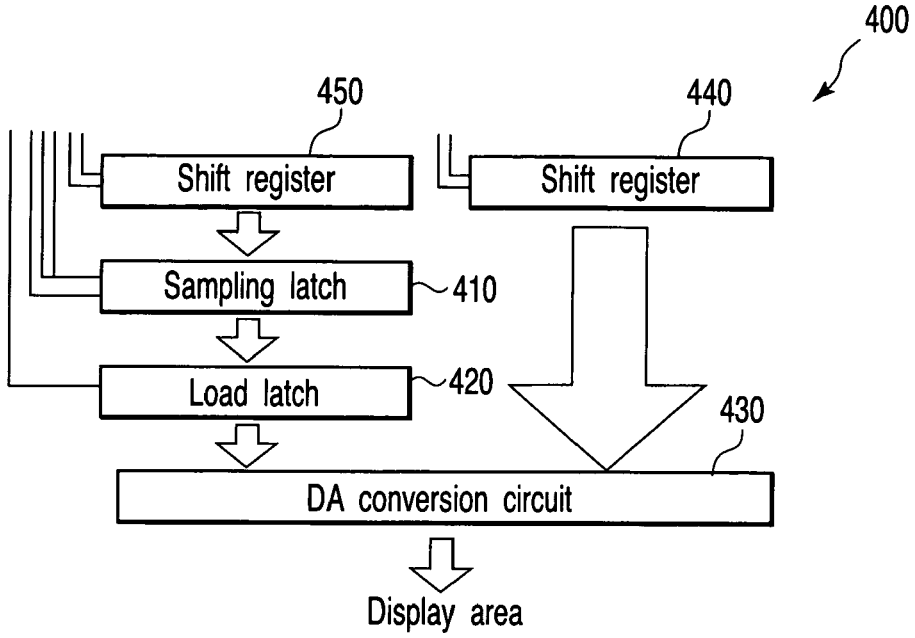
FIG. 8 is a schematic block diagram of the video signal driver according to a modification of the invention.
Figure 9:
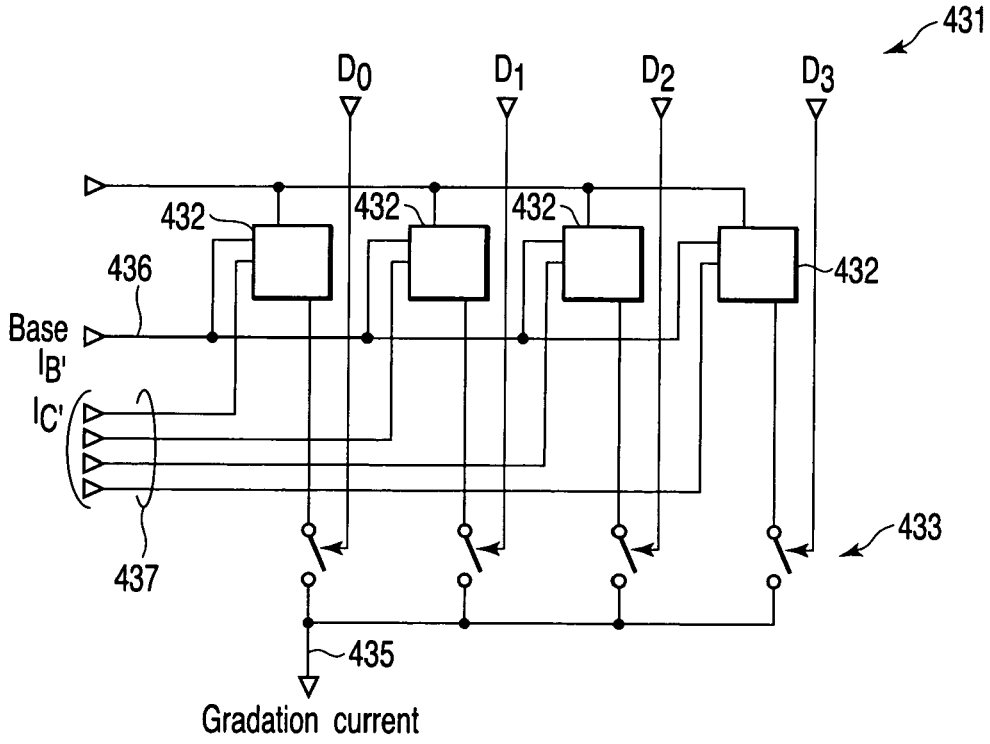
FIG. 9 schematically shows a DA unit according to a modification of the invention.

The supply of current signals using difference currents can also be applied to the video signal driver. FIGS. 8 and 9 show a video signal driver 400 of the organic EL display device 1 according to a modification of the present invention. The video signal driver 400 is further provided with a shift register 440 which outputs refresh timing pulses to control the timing of periodically storing constant currents in gradation reference current sources 432 in a current output DA conversion circuit 430 and a circuit which collectively outputs gradation currents IC output through the DA conversion circuit 430 to the second video signal lines 104 for each row of the pixels 100.

The DA conversion circuit 430 includes DA units 431 which convert a data signal DATA into an analog current signal in synchronization with the refresh timing pulses output from the shift register 440. The DA units 431 are provided in correspondence with the video signal lines 104.

Figure 10:
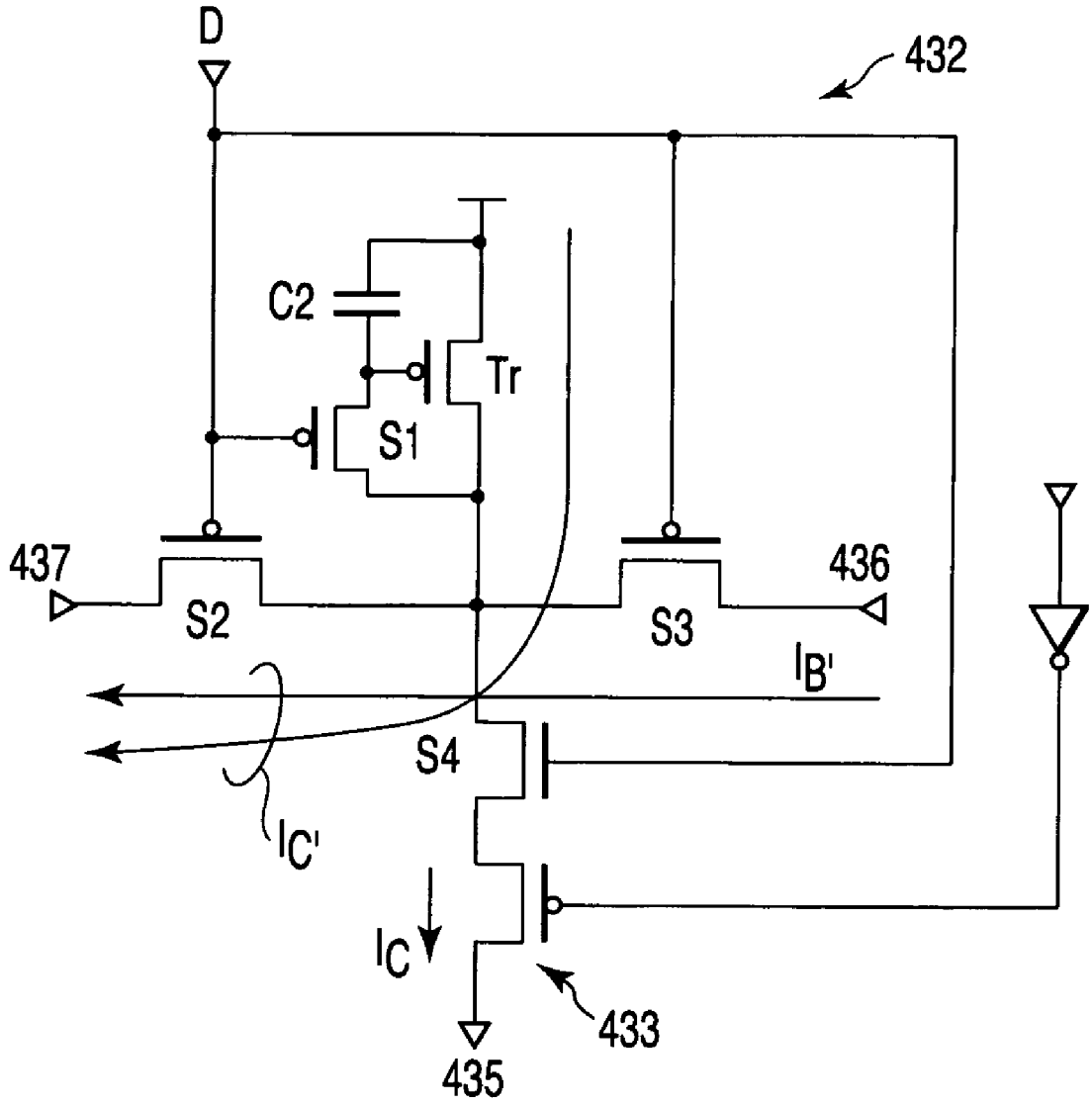
FIG. 10 is the circuit diagram of a gradation reference current source according to a modification of the invention.

As shown in FIGS. 9 and 10, each DA unit 431 has gradation reference current sources 432 corresponding in number to bits of the data signal DATA, a switch circuit 433 which controls whether or not to output the outputs of the respective gradation reference current sources 432 according to the data signal DATA, a gradation current line 435 which connects together the output terminals of the switch circuit 433, a base current supply line 436 which supplies a common base current $I_B'$ to the gradation reference current sources 432, and constant current supply lines 437 which supply different constant currents $I_C'$ to the gradation reference current sources 432. Here, there is illustrated a case where each DA unit 431 operates on a four-bit data signal DATA (D0-D3).

The gradation reference current source 432 forming the DA unit 431 corresponding to one bit stores a gradation reference current I0-I3 input at select time and outputs the stored gradation reference current I0-I3 at non-select time. Here, it is comprised of a two-input current copy circuit. That is, the gradation reference current source is composed of a transistor Tr, a switch S1 connected between the gate and drain of the transistor Tr, a switch S2 connected between the drain of the transistor Tr and the constant current supply line 437, a switch S3 connected between the drain of the transistor Tr and the base current supply line 436, a switch S4 connected between the drain of the transistor Tr and the output terminal of the current copy circuit, and a capacitor C2 connected at its both terminals to the gate and source of the transistor. That is, the circuit operates in such a way that a self-bias circuit is formed between the gate and drain of the transistor Tr in a state where the switches S1, S2 and S3 are rendered conductive and the switch S4 is rendered nonconductive and a current flowing between the source and drain of the transistor Tr through the switch S1 becomes a desired gradation reference current I0-I3.

The gradation reference current I0-I3 is set by controlling so that the constant current Ic' set through the constant current supply line 437 becomes the sum of the base current $I_B'$ and the gradation reference current I0-I3. That is, the operation is performed so that the gradation reference current I0-I3 becomes the difference current between the sum current and the gradation base current $I_B$. Next, the switches S1, S2 and S3 are rendered nonconductive and the switch S4 is rendered conductive and, in this state, the gate-to-source voltage when the current flowing the source and drain of the transistor Tr becomes equal to the difference current is stored on the capacitor C2 and the gradation reference current I0-I3 is output via the switch S4. The switches S1-S4 are controlled by the common control signal Scanb and the refresh timing pulse from the shift register SR. The switches S1 to S3 are formed of thin-film transistors of the same polarity, while the switch S4 is comprised of a thin-film transistor of different polarity to the switches S1 to S3. In this embodiment, the transistor Tr and the switches S1 to S3 are p-type thin-film transistors, while the switch S4 is an n-type thin-film transistor.

For example, to set the gradation reference current I0-I3 to 0.01 μA, it is only required to set the constant current (sum current) supplied from the constant current supply line to 1.01 μA and the base current $I_B'$ to 1 μA. Since a current of 1 μA or more flows to each input terminal, even if a capacitance of 10 pF is associated with it, the capacitance can be charged within 10 μs, allowing the transistor to go into the operating state to allow 0.01 μA to flow.

Whether or not to output the difference current from the gradation reference current source 432 is controlled by the switch circuit 433 according to the data signal DATA. The total of the output currents of the respective switch circuits 433 flows on the gradation current line 435 as the gradation current $I_C$.

Thus, even in the gradation reference current source 432 in the DA unit, writing is performed through the difference current and, even if the capacitive load to the input terminal is large, a greater constant current can be supplied to remedy the shortage of charge.

Next, an organic EL display device according to a second embodiment of the present invention will be described.

In this embodiment, in signal supply from an external circuit to an array substrate, supply of the base current IB and the gradation current IC using the same terminal will be described.

Figure 11:
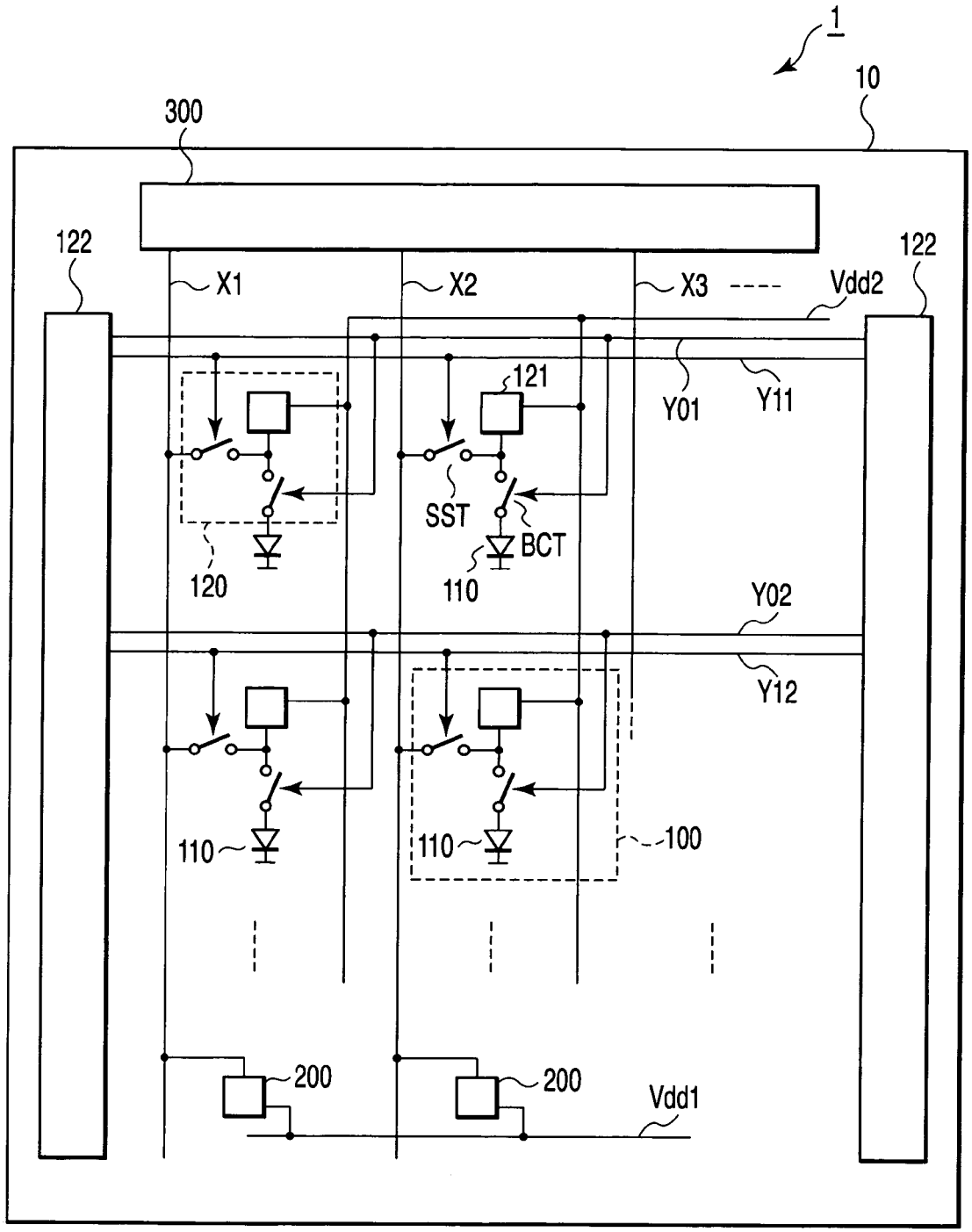
FIG. 11 is a schematic plan view of an organic EL display device according to a second embodiment of the present invention.

As shown in FIG. 11, the organic EL display device 1 is constructed as a large active matrix display device of a model of 10 or more in size by way of example. The device is provided with a plurality of pixels 100 arranged in the form of a matrix (M×N) on an insulating support substrate 10 made of glass or the like, a plurality of scan lines Y1*n*-Y3*n* (n=1, 2, 3, . . ., N) and a plurality of output control lines Y0*n* arranged along the row direction of the pixels 100, a plurality of video signal lines Xm (m=1, 2, 3, . . . , M) arranged along the column direction of the pixels 100, power supply lines Vdd1 and Vdd2, scan drivers 122 which output scan signals Ysig1*n*-Ysig3*n* onto the scan lines Y1*n*-Y3*n* and control signals YsigO*n* onto the output control lines Yon, a video signal driver 300 which outputs base currents $I_B$ and gradation currents $I_C$ as a video signal onto the video signal lines Xm, and a plurality of base current storage units 200 each of which stores the base current $I_B$ supplied from the video signal driver 300 and outputs it to a corresponding one of the video signal lines Xm.

Figure 15:
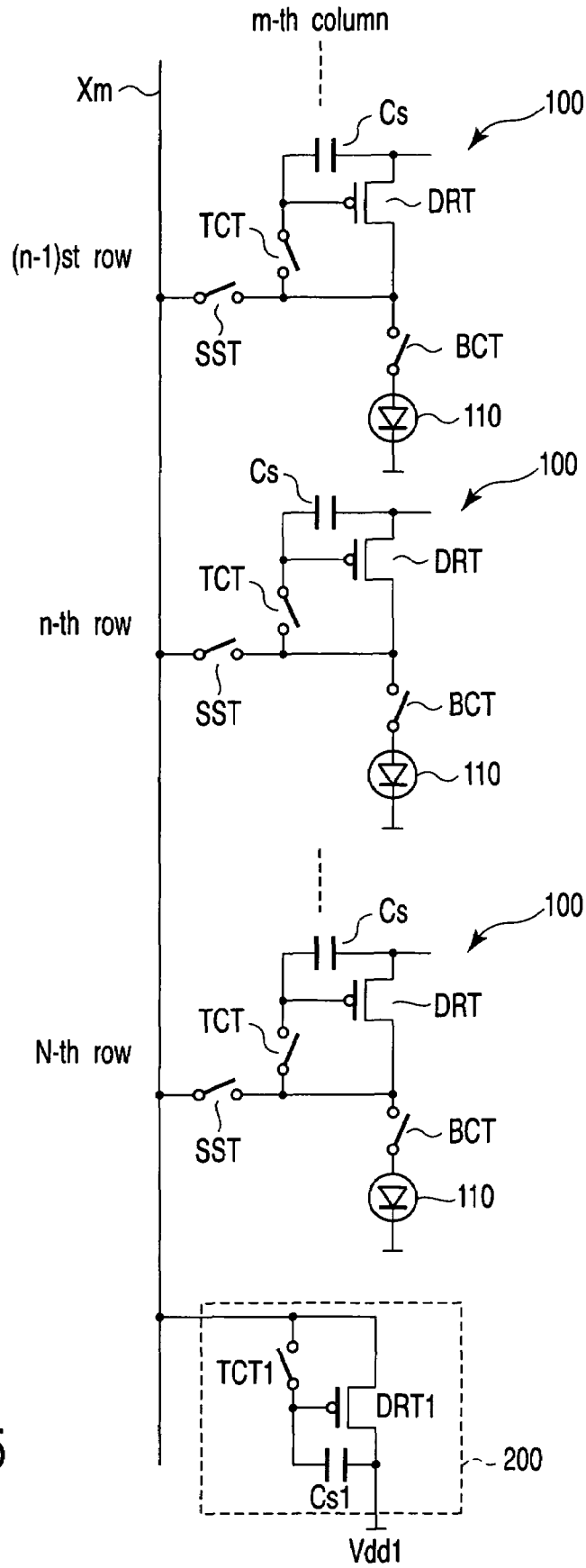
FIG. 15 schematically shows a part of the organic EL display device of the second embodiment.

The base current storage unit 200 is provided, as shown in FIG. 15, with a first transistor DRT1 connected between the first voltage power supply Vdd1 and the video signal line Xm, a first capacitor Cs1, one electrode of which is connected to the gate of the first transistor DRT1, and maintains a constant potential difference between the gate and source of the first transistor DRT1, and a first switch TCT1 connected between the gate and drain of the first transistor DRT1. Although the first capacitor Cs1 is connected between the gate and source of the first transistor DRT1, this is not restrictive. For example, the first transistor DRT1 and the first switch TCT1 are each comprised of a p-type thin-film transistor. The base current storage units 200 are formed integrally and simultaneously on the support substrate 10 on which the pixels 100 are formed.

Each pixel 100 includes a display element 110 having a light activation layer between opposed electrodes and a pixel circuit 120 which supplies a drive current to drive the display element 110. The display element 110 is, for example, a self-emission element and here is an organic EL element having at least an organic light emission layer as the light activation layer.

The pixel circuit 120 is adapted to store the difference current $I_C$-$I_B$ of gradation current $I_C$ and base current $I_B$ when the pixel 100 is selected and output the stored difference current $I_C$-$I_B$ to the display element 110 as drive current $I_D$ when the pixel 100 is not selected. The pixel circuit 120 is equipped with a pixel switch SST which controls whether or not to select the pixel 100, a drive current storage unit 121 which stores the drive current, and an output switch BCT which controls whether or not to output the drive current from the drive current storage unit 121 to the display element 110.

Figure 12A:
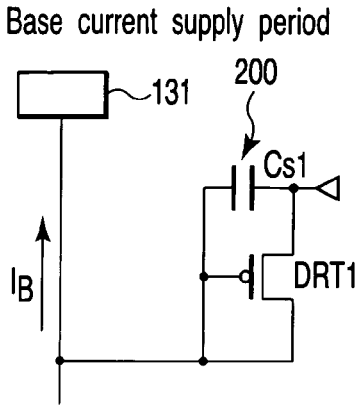
FIGS. 12A, 12B and 12C are diagrams for use in explanation of the operation of the organic EL display device of the second embodiment.

First, as shown in FIG. 12A, in a base current supply period, a given base current $I_B$ is caused to flow through the video signal line Xm through the first transistor DRT1 in the base current storage unit 200 and the gate-to-source voltage of the first transistor DRT1 corresponding to that base current $I_B$ is written into the first capacitor Cs1. At this point, the drive current storage unit 121 is electrically isolated from the video signal line.

Here, the base current $I_B$ is a current signal set by a constant current source 131 to a predetermined value and is set to a greater value than the amount of charge corresponding to a potential change (maximum voltage change ΔV) from the highest gradation display to the lowest gradation display in the video signal line capacitance (Cp) during one horizontal scan period (t) ($I_B$>Cp×ΔV/t). For example, the base current is set to a magnitude comparable to the drive current for the highest gradation display. As an example, in full color display, with pixels 100 that emit red light, the drive current for the highest gradation display is of the order of 2 μA.

Figure 12B:
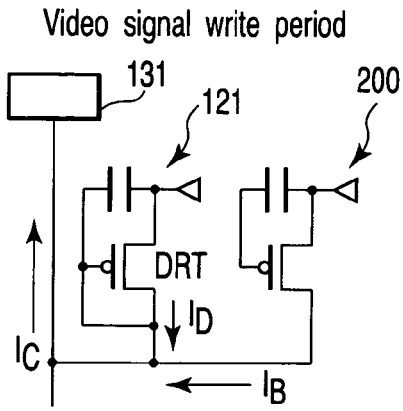

Next, as shown in FIG. 12B, in a video signal write period, the gate-to-source voltage of the first transistor DRT1 corresponding to the base current $I_B$ is held on the first capacitor Cs1 at the time when the gate of the first transistor DRT1 is disconnected from the drain. By outputting the base current IB stored in the base current storage unit 200 to the video signal line Xm and supplying a gradation current $I_C$ corresponding to a video signal, a desired drive current $I_D$ is caused to flow into the drive current storage unit 121 and stored therein.

Here, the drive current $I_D$ is a current signal set so that the amount of current flowing between the source and drain of the drive transistor DRT in the pixel circuit 120 to be described later has a desired magnitude. The drive current is set to a magnitude corresponding to the sum of the base current $I_B$ and the drive current $I_D$ applied to the display element 110. That is, the amount of current flowing between the source and drain of the drive transistor DRT is set to the difference current $I_C$-$I_B$ between the gradation current $I_C$ and the base current $I_B$. Although, in the description which follows, the embodiment is described as the base current $I_B$ being fixed and the gradation current $I_C$ being variable, it is also possible to make both of them variable.

Figure 12C:
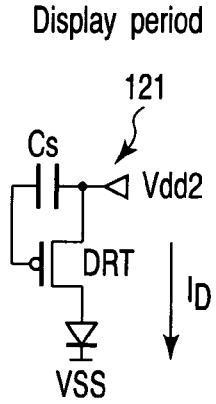

As shown in FIG. 12C, in a display period, the drive current $I_D$ stored in the drive current storage unit 121 is supplied to the display element 110 in a state where the pixel 100 is electrically disconnected from the video signal line Xm, thereby operating the display element 110.

For example, to make a black display with a voltage change of 3 V, it is only required to set the base current $I_B$ to 2.0 μA and the gradation current $I_C$ to 2.0 μA. Since a current of not less than several microamperes flows through the line to the input terminal of each pixel 100 (the input of the pixel switch SST), even if a capacitance of 10 pF is associated with it, the capacitance can be charged within 15 μs, allowing a stable display operation to be performed without causing the shortage of time required for writing a video signal into the pixel circuits 120.

Thus, the same advantages as with the first embodiment can be obtained.

In the present embodiment, the base current storage units 200 are provided on the same substrate as the display elements 110 and can be formed at the same time and in the same manufacturing process as the lines and the thin-film transistors constituting the pixel circuits 120. Thus, by incorporating the base current storage units 200 into the display device, the length of the lines that convey current signals can be reduced, resulting in lowered capacitive load and allowing stable current signal supply. In addition, the number of points for connection to external circuits can be reduced, allowing the mechanical reliability to be increased. Since the pixel circuits 120 and the base current storage units 200 are formed on the same substrate and in the same manufacturing process, their constituent elements can have similar characteristics, allowing variations in display element drive current to be suppressed.

Figure 13:
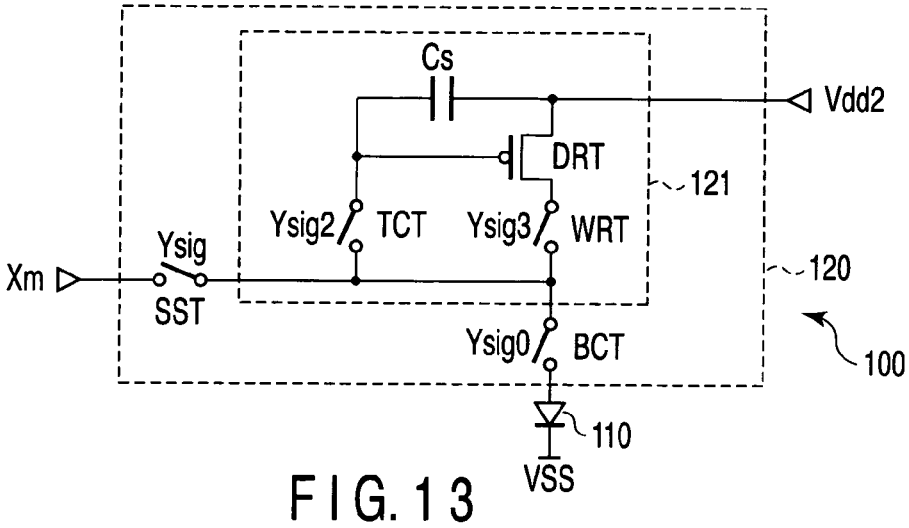
FIG. 13 schematically shows a pixel of the organic EL display device of the second embodiment.

Each pixel 100 is configured as shown in, for example, FIG. 13. In this case, the drive current storage unit 121 is composed of the drive transistor DRT connected in series with the display element 110 and the output switch BCT between the second voltage power supply Vdd2 and the third voltage power supply Vss, a write switch WRT connected between the drain of the drive transistor DRT and the output switch BCT, a correction switch TCT connected between the gate of the drive transistor DRT and the drain of the drive transistor DRT through the write switch WRT, and the capacitor Cs which maintains constant potential difference between the gate and source of the drive transistor DRT. The gate of the drive transistor DRT is connected through the correction switch TCT and the pixel switch SST to the video signal line Xm. The drain of the drive transistor DRT is connected through the write switch WRT and the pixel switch SST to the video signal line Xm. Such a configuration is referred to as a current copy type.

Figure 14:
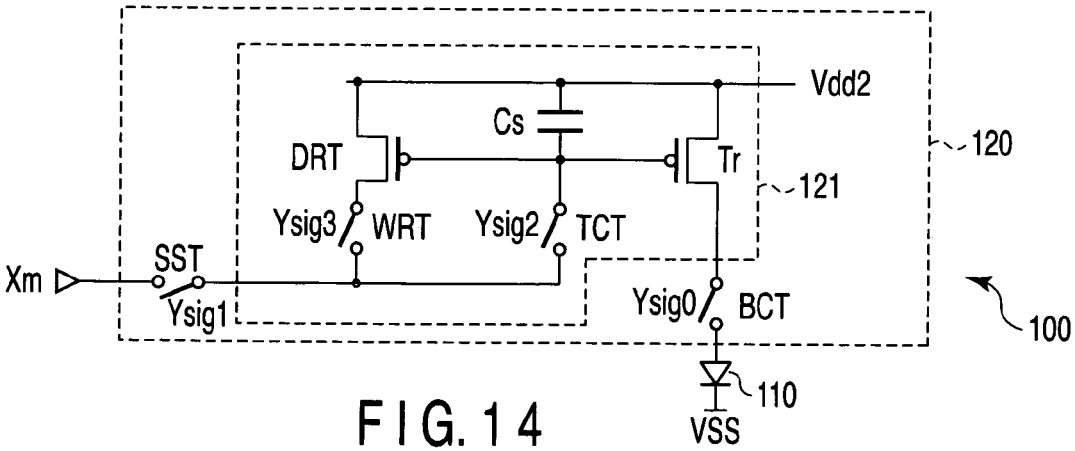
FIG. 14 shows another embodiment of the pixel.

Each pixel 100 may be configured as shown in, for example, FIG. 14. In this modification, the drive current storage unit 121 has a transistor Tr arranged in a current mirror relationship with respect to the drive transistor DRT. The drive transistor DRT is used in writing a video signal when the pixel 100 is selected and, when the pixel 100 is nonselected, a current which is approximately equal in magnitude to the current written through the drive transistor DRT is output through the transistor Tr to the display element 110 as a drive current. Such a configuration is referred to as a current mirror type. In this case, the output switch BCT may be omitted.

In the pixels 100 shown in FIGS. 13 and 14, the write switch WRT may be omitted when the base current output of the base current storage unit 200 is applied to the video signal driver 300 via the video signal line Xm without intervention of the pixel 100. In this case, the first transistor DRT1, the correction switch TCT and the pixel switch SST are placed in a state where their drains are connected together at all times.

Thus, the present invention can be adapted to various types of display devices 1 in which the pixels 100 are written with video signals through current signals.

In the second embodiment, the thin-film transistors constituting the pixel circuit 120 are all formed through the same manufacturing process into the same layer structure and are thin-film transistors of the top gate structure using polysilicon for semiconductor layers. In addition, an increase in the number of manufacturing steps can be suppressed by constituting the pixel circuit with thin-film transistors which are all identical in conductivity type.

The second embodiment will be described in more detail hereinafter.

Figure 16:
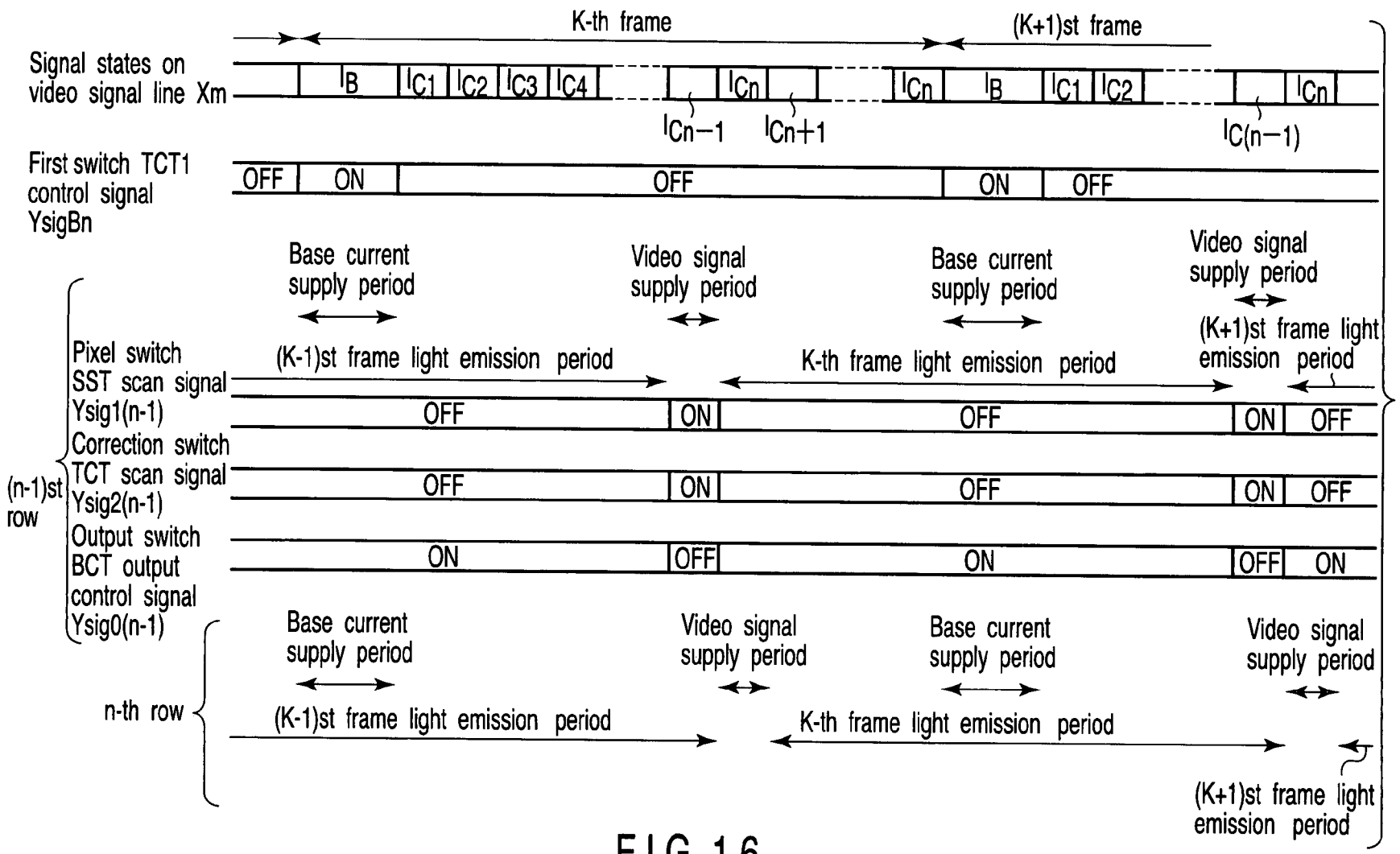
FIG. 16 is a timing chart of the organic EL display device of the second embodiment.

As shown in FIGS. 11 and 15, the base current storage unit 200 is provided for each video signal line Xm. FIG. 15 shows a relationship between the pixels 100 connected to the video signal line Xm in the m-th column by way of example and the base current storage unit 200 and FIG. 16 is a timing chart thereof.

The first switch TCT1 of the base current storage unit 200 is connected to a common control line Ybn and subject to on-off control through a control signal YsigBn.

The pixel switch SST and the correction switch TCT in each pixel 100 are respectively connected to first and second scan lines Y1*n* and Y2*n* which are common to the pixels 100 in the same row and subject to on-off control by scan signals Ysig1*n* and Ysig2*n* supplied from the scan driver 122 integrally formed on the support substrate 100. The output switch BCT is connected to an output control line Y0*n* which is common to the pixels 100 in the same row and subject to on-off control by a control signal Ysig0*n* supplied from the scan driver 122.

The scan driver 122 includes a shift register and output buffers. The driver transfers an externally applied horizontal scan start pulse in sequence from one stage to the next and applies the output of each stage through the output buffer onto the first scan line Y1*n* as the scan signal Ysig1*n*. This timing is synchronous with one horizontal scan period. By signal processing the output of each stage, the output control signal Ysig0*n* or scan signals Ysig2*n* and Ysig3*n* are applied to the corresponding output control line Yon and scan lines Y2*n* and Y3*n*. The control signal YsigBn is produced based on an output (or input) of the shift register of the scan driver 122.

The drain of the drive transistor DRT is connected to the video signal line Xm which is common to the pixels 100 in the same column through the pixel switch SST and is in turn connected through the video signal line to the video signal driver 300 which is a drive circuit. The base current $I_B$ and the gradation current $I_C$ are set in the video signal driver 300 on a time division basis and supplied using the same video signal line Xm. The base current storage unit 200 is written with the base current $I_B$ from the video signal driver 300 each time a frame of a video signal is rewritten, i.e., every vertical period to refresh the stored contents. When the pixel switch SST and the correction switch TCT are formed of thin-film transistors of the same conductivity type, their scan lines can be made common to each other.

Figure 17:
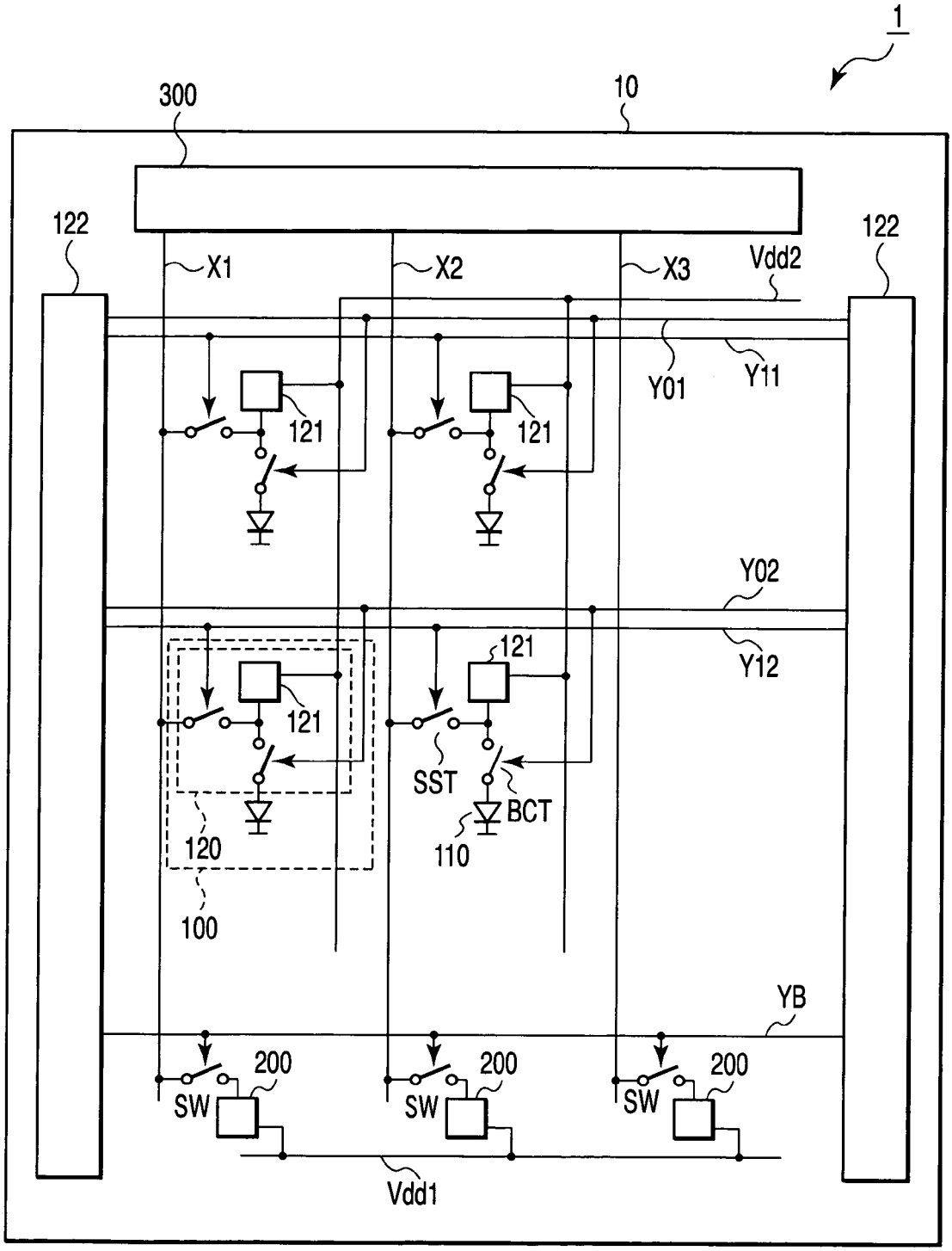
FIG. 17 is a plan view of an organic EL display device according to a third embodiment of the present invention.

Next, an organic EL display device according to a third embodiment of the present invention will be described. As shown in FIG. 17, the base current storage unit 200 is provided for each video signal line Xm. The input and output of base current is controlled by a base current switch SW connected between the drain of the first transistor DRT1 and the video signal line.

Figure 18:
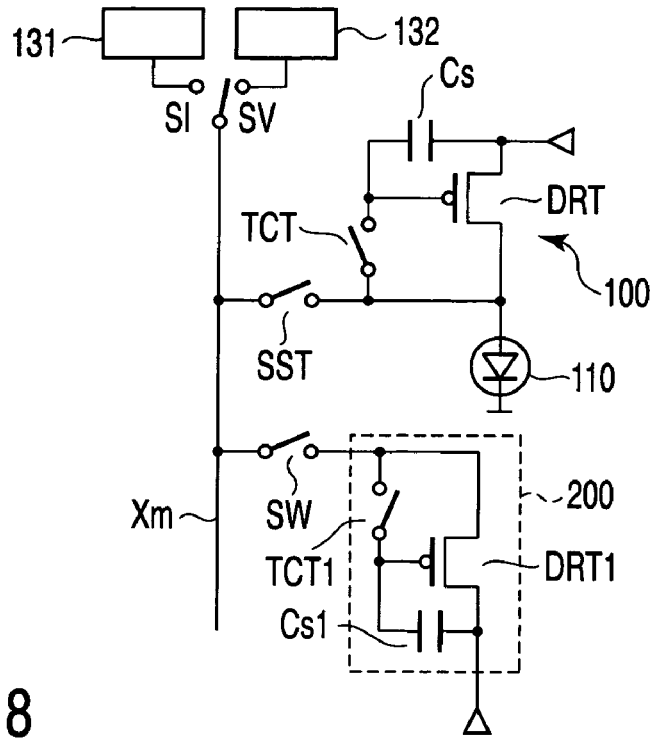
FIG. 18 schematically shows a pixel and a base current storage unit in the organic EL display device of the third embodiment.
Figure 19:
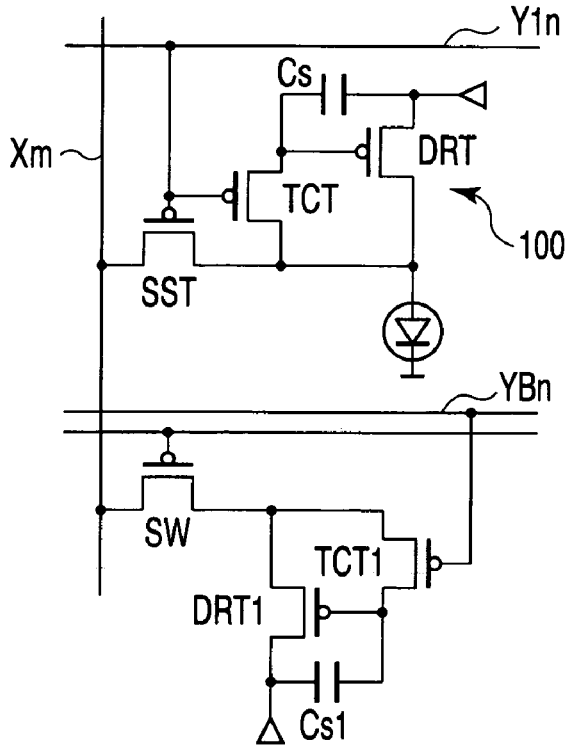
FIG. 19 shows equivalent circuits of the pixel and the base current storage unit.

FIG. 18 schematically shows a relationship between a certain pixel 100 and the base current storage unit 200 associated with the video signal line Xm in the organic EL display device. FIG. 19 shows an equivalent circuit thereof. FIGS. 20A through 20D show the operations of the pixel and the base current storage unit 200. FIG. 21 is a timing chart which indicates, in the order starting with the top, current/voltage switched states in the driver (S1 indicates constant current output and SV indicates constant voltage output), signal states on the video signal line in the m-th column, control signal to the base current switch SW, control signal to the first switch TCT1, scan signals to the pixel 100 at the intersection of the (n−1)th row and the m-th column, and scan signals to the pixel 100 at the intersection of the n-th row and the m-th column. Here, the pixel switch SST and the correction switch TCT are controlled by the same scan line.

The video signal driver 300 is provided, in addition to a constant current source 131 which outputs a gradation signal, with a constant voltage source 132 which outputs a halftone writing potential, for example, a potential of 3 V, as a precharge voltage Vp.

Figures 20A, 20B, 20C, 20D:
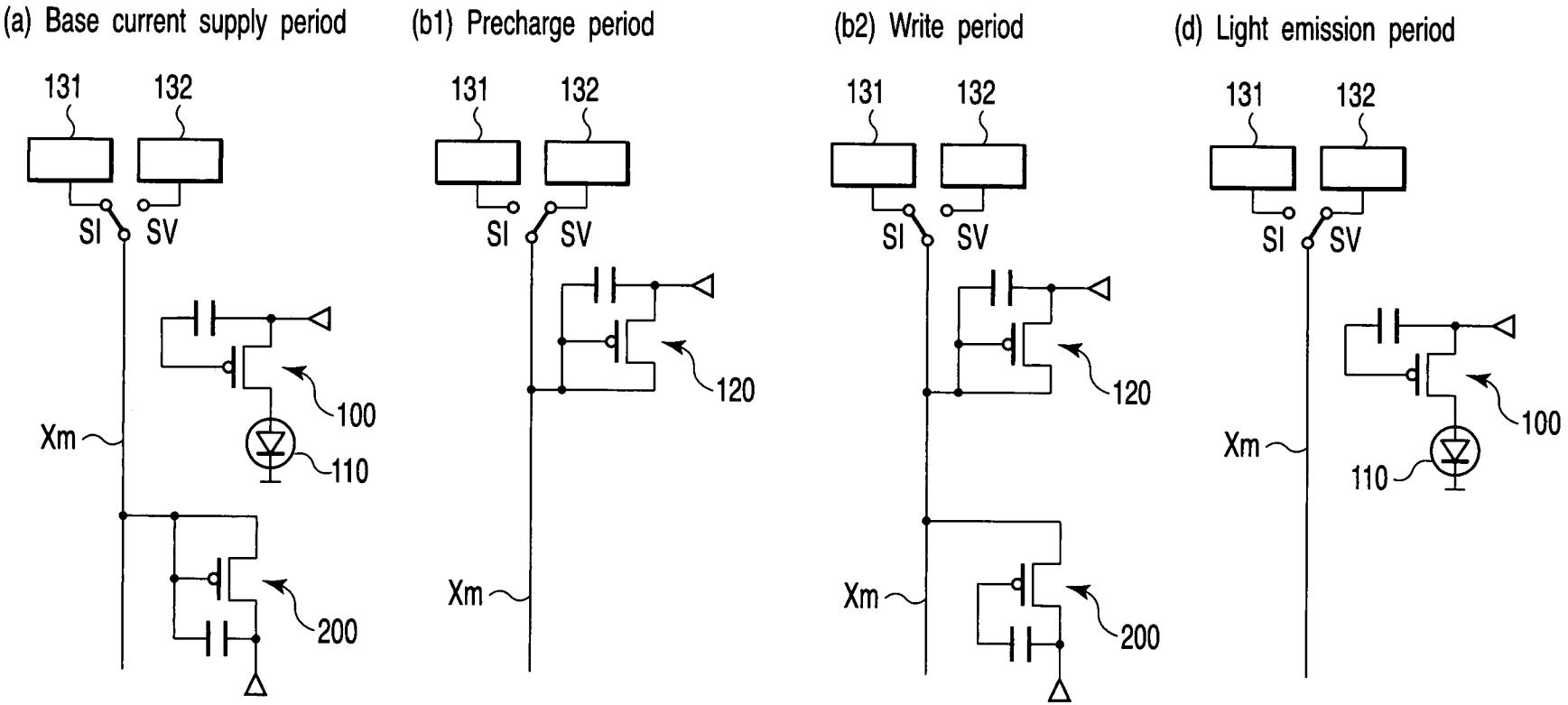
FIGS. 20A, 20B, 20C and 20D are diagrams for use in explanation of the operation of the organic EL display device of the third embodiment.
Figure 21:
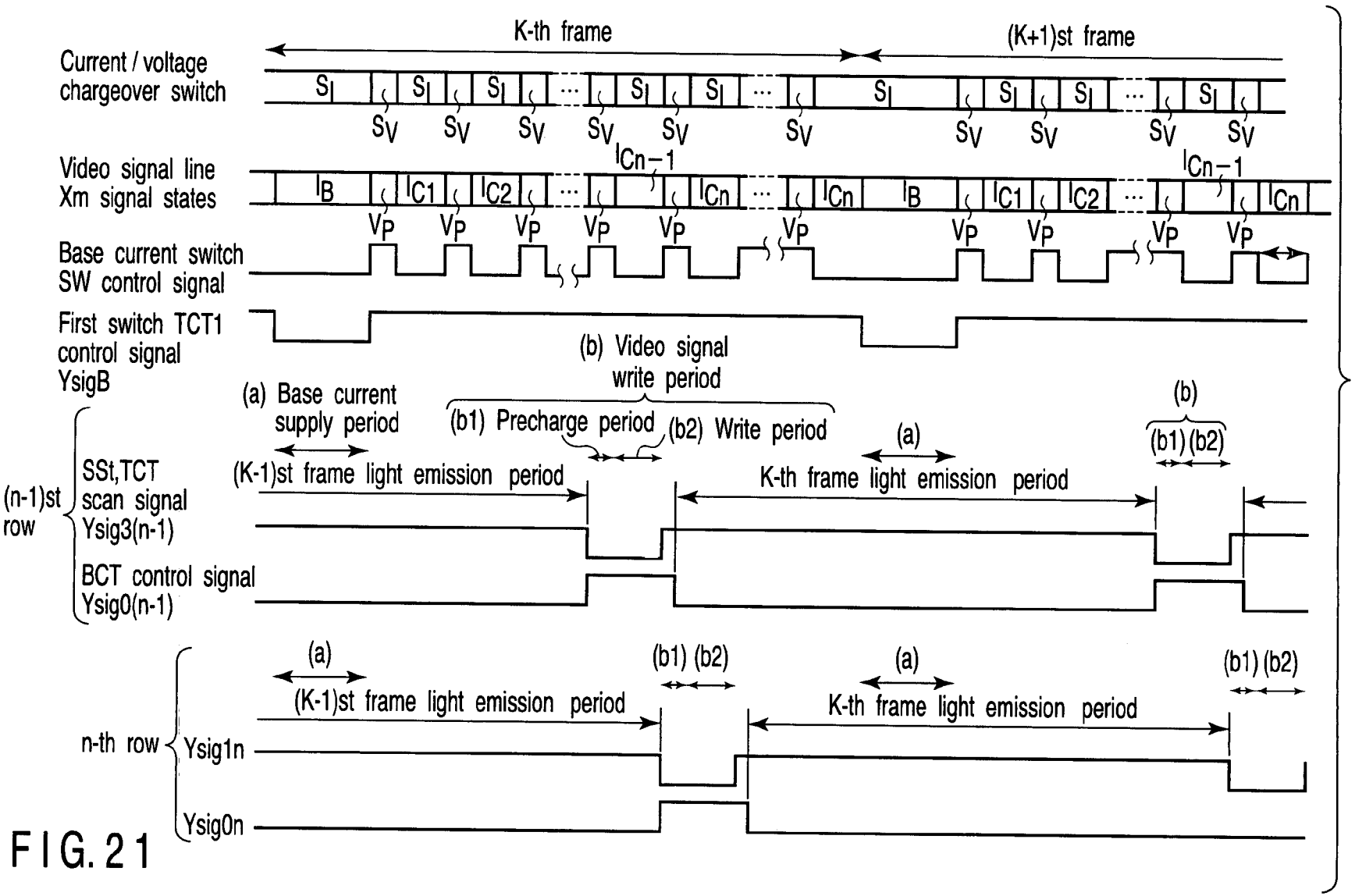
FIG. 21 is a timing chart of the organic EL display device of the third embodiment.

After the writing of a base current from the constant current source 131 into the base current storage unit 200 as shown in FIG. 20A, the SW of the base current storage unit 200 is turned off and the constant voltage source 132 precharges the drive current storage unit 121 with the precharge voltage Vp as shown in FIG. 20B. Subsequently, after the supply of the written base current to the drive current storage unit 121 to write a drive current into it as shown in FIG. 20C, the display element 110 is driven with the drive current to emit light as shown in FIG. 20D. Thus, by time-dividing the video signal write period, the drive transistor DRT of the drive current storage unit 121 can be previously placed in a good operating state with each row writing.

Figure 22:
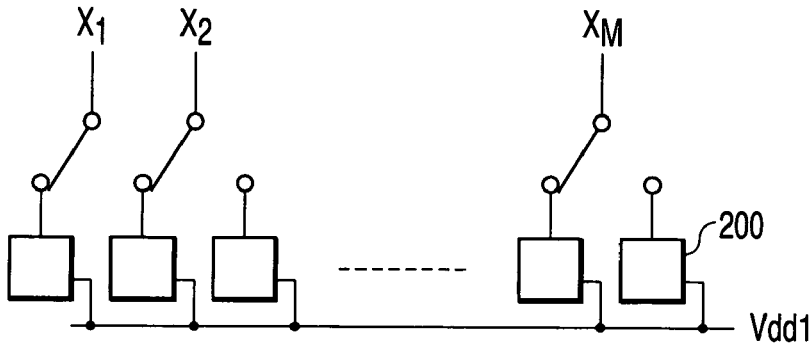
FIG. 22 shows a part of an organic EL display device according to a fourth embodiment of the present invention.
Figure 23:
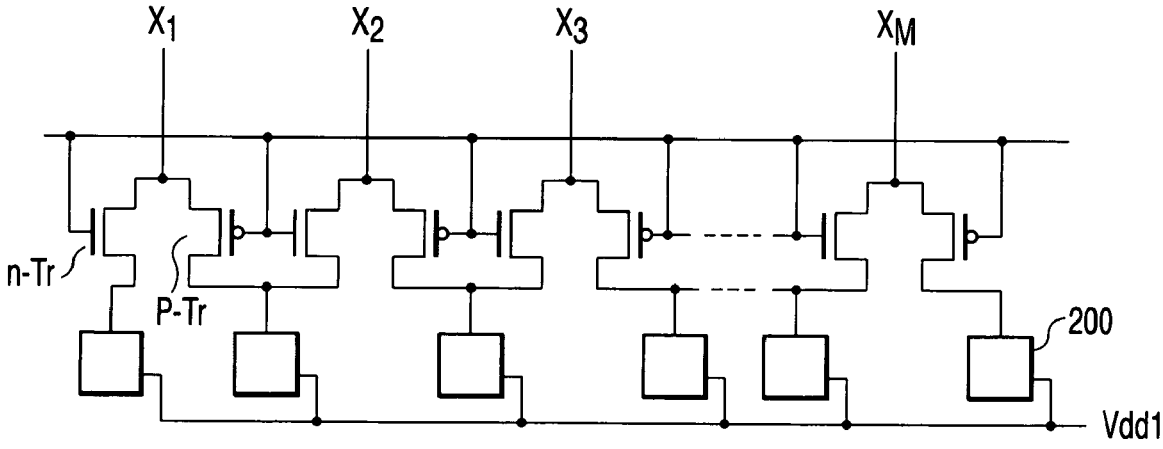
FIG. 23 shows a part of an organic EL display device of the fourth embodiment.

An organic EL display device according to a fourth embodiment of the present invention is provided, as shown in FIG. 22, with base current storage units 200 which are one more than there are video signal lines, which allows the pixels 100 to be operated using the outputs of the base current storage units 200 which differ at every predetermined period, e.g., every vertical period. In this case, as shown in FIG. 23, a set of paired thin-film transistors opposite to each other in conductivity type, i.e., an n-type thin-film transistor n-Tr and a p-type thin-film transistor p-Tr, is placed for each video signal line Xm. Different base current storage units 200 are connected to the thin-film transistors in each set.

Thus, by switching between the base current storage units 200 for connection to the video signal line Xm, output variations in base current can be averaged, allowing the display operation to be made better.

Figure 24:
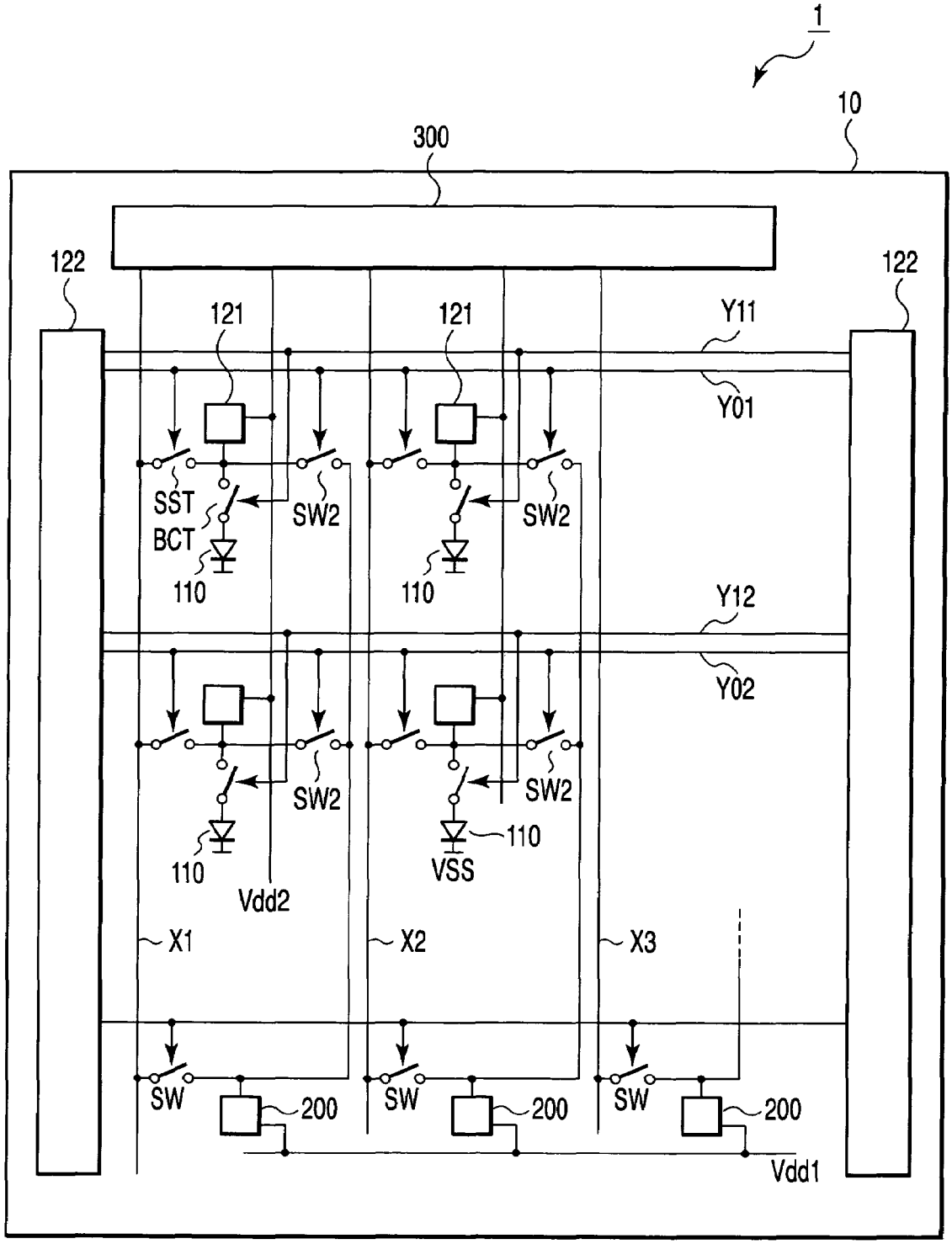
FIG. 24 is a plan view of an organic EL display device according to a fifth embodiment of the present invention.

As shown in FIG. 24, an organic EL display device according to a fifth embodiment of the present invention further includes a second base current switch SW2 for each pixel 100 and is configured so as to supply the output of the corresponding base current storage unit 200 to the video signal line Xm via the pixel switch SST. The second base current switch SW2 is connected between the base current storage unit 200 and the drive current storage unit 121. For example, the second base current switch SW2 is formed, like the pixel circuit 120, of a p-type thin-film transistor, which has its source connected to the drain of the first transistor DRT1 in the base current storage unit 200 and its drain connected to the drain of the drive transistor in the drive current storage unit 121.

Thus, by outputting the base current via the pixel switch SST and the second base current switch SW2 not via the video signal line Xm, the base current supply can be performed, realizing a good display operation. In this case, it is desirable that the time required to switch between output control signals Ysig0*n* and Ysig0*n*+1 that scan across adjacent output control lines be very short (at approximately the same time). When there is an interval between the moment that the previous row is turned off and the moment that the next row is turned on, it is desirable to provide a switch at the output terminal of the base current storage unit 200 to establish electrical disconnection between the base current storage unit and the above line during that interval.

By controlling the second base current switch SW2 through the same signal as the pixel switch SST, that is, by connecting the gate of the second base current switch SW2 to the same scan line as the gate of the pixel switch SST, an increase in the number of lines can be suppressed.

Figure 25:
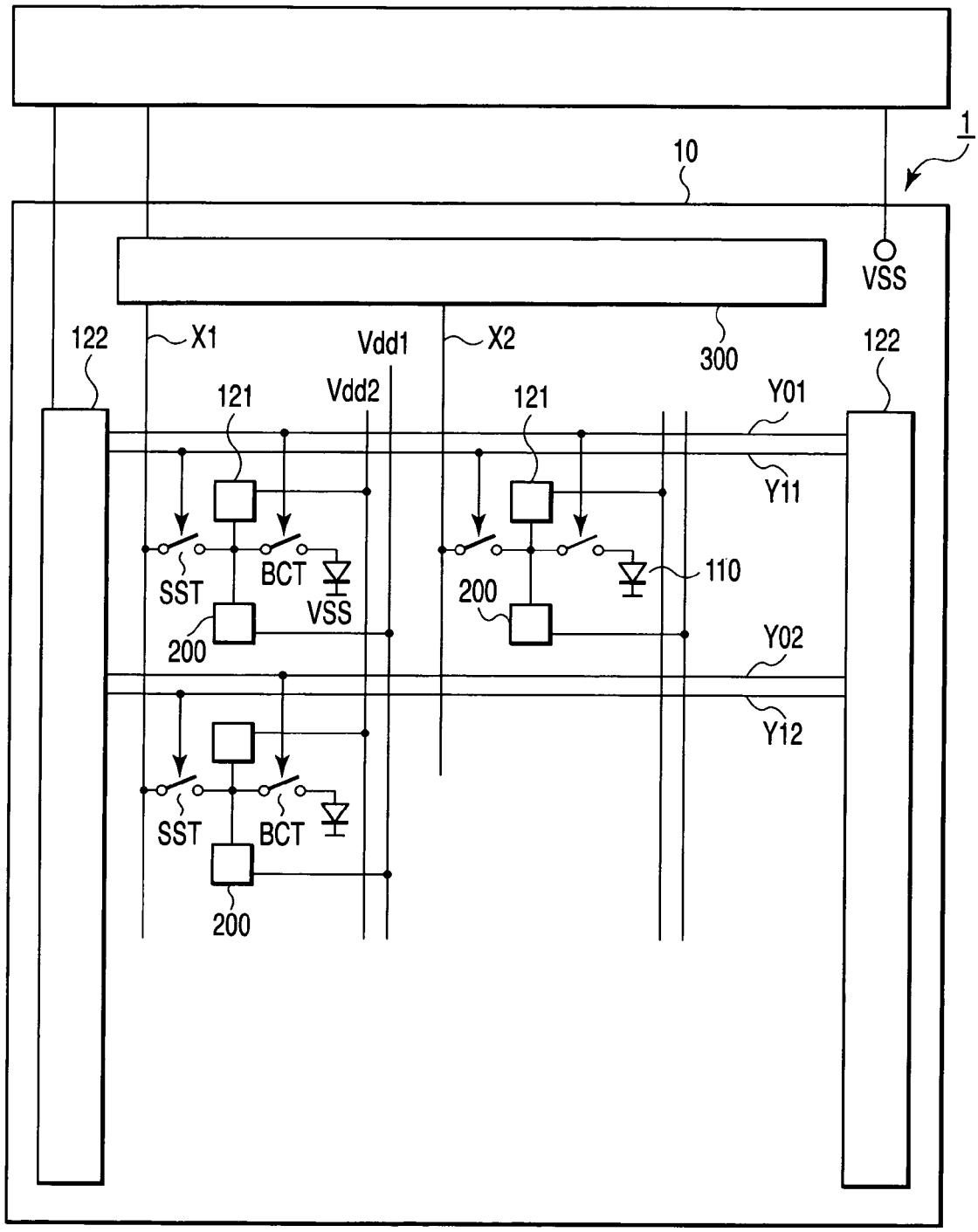
FIG. 25 is a plan view of an organic EL display device according to a sixth embodiment of the present invention.

According to an organic display device of a sixth embodiment of the present invention, as shown in FIG. 25, the base current storage unit 200 is provided for each pixel 100. In the base current storage unit 200, the drain of the first transistor DRT1 is connected to the video signal line Xm through the pixel switch SST of the pixel circuit 120. The base current and the gradation current are set in the video signal driver 300 and supplied to a plurality of base current storage units 200 using the same video signal line Xm on a time division basis.

Figure 26:
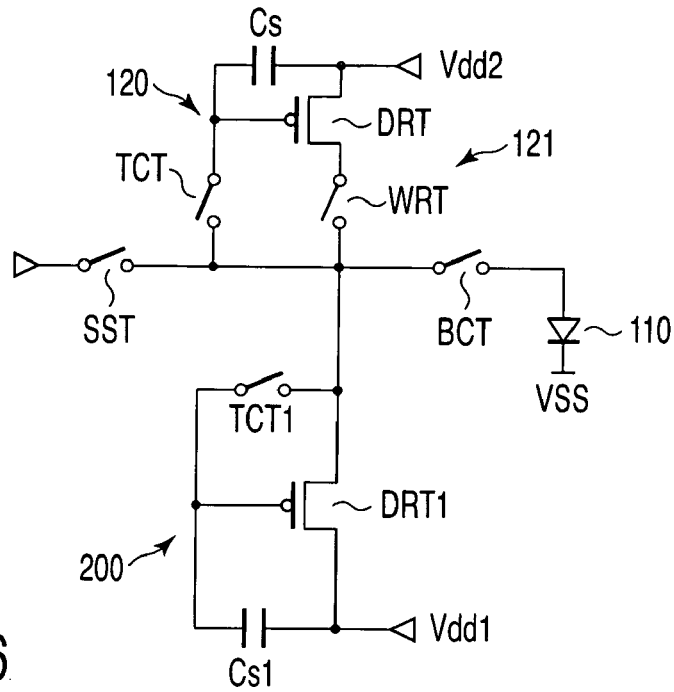
FIG. 26 schematically shows a pixel and a base current storage unit in the organic EL display device of the sixth embodiment.
Figure 27:
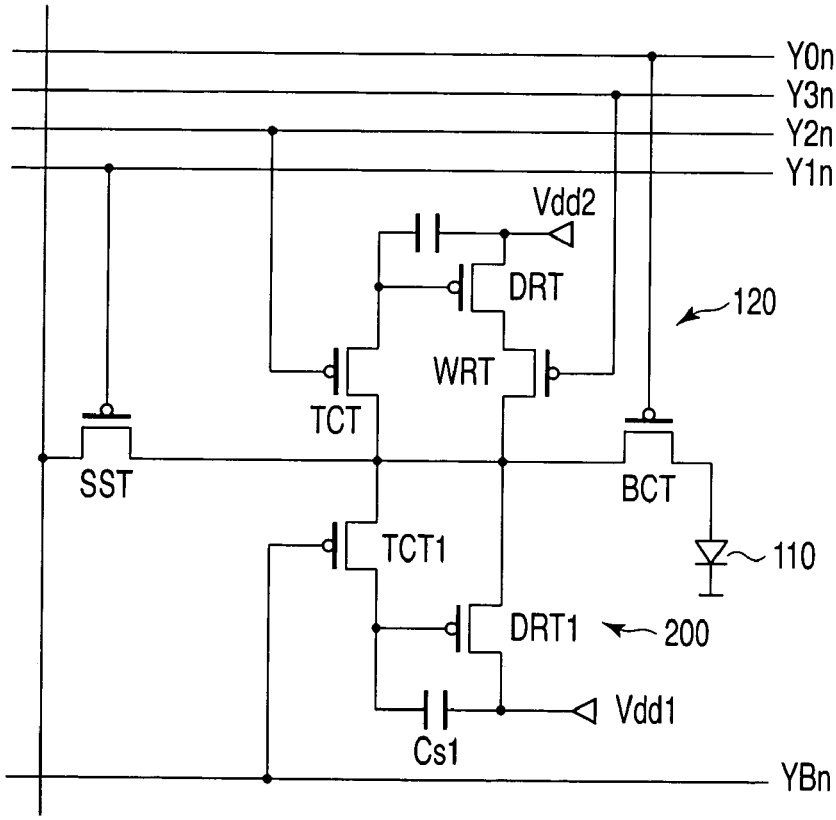
FIG. 27 shows equivalent circuits of the pixel and the base current storage unit.
Figure 28:
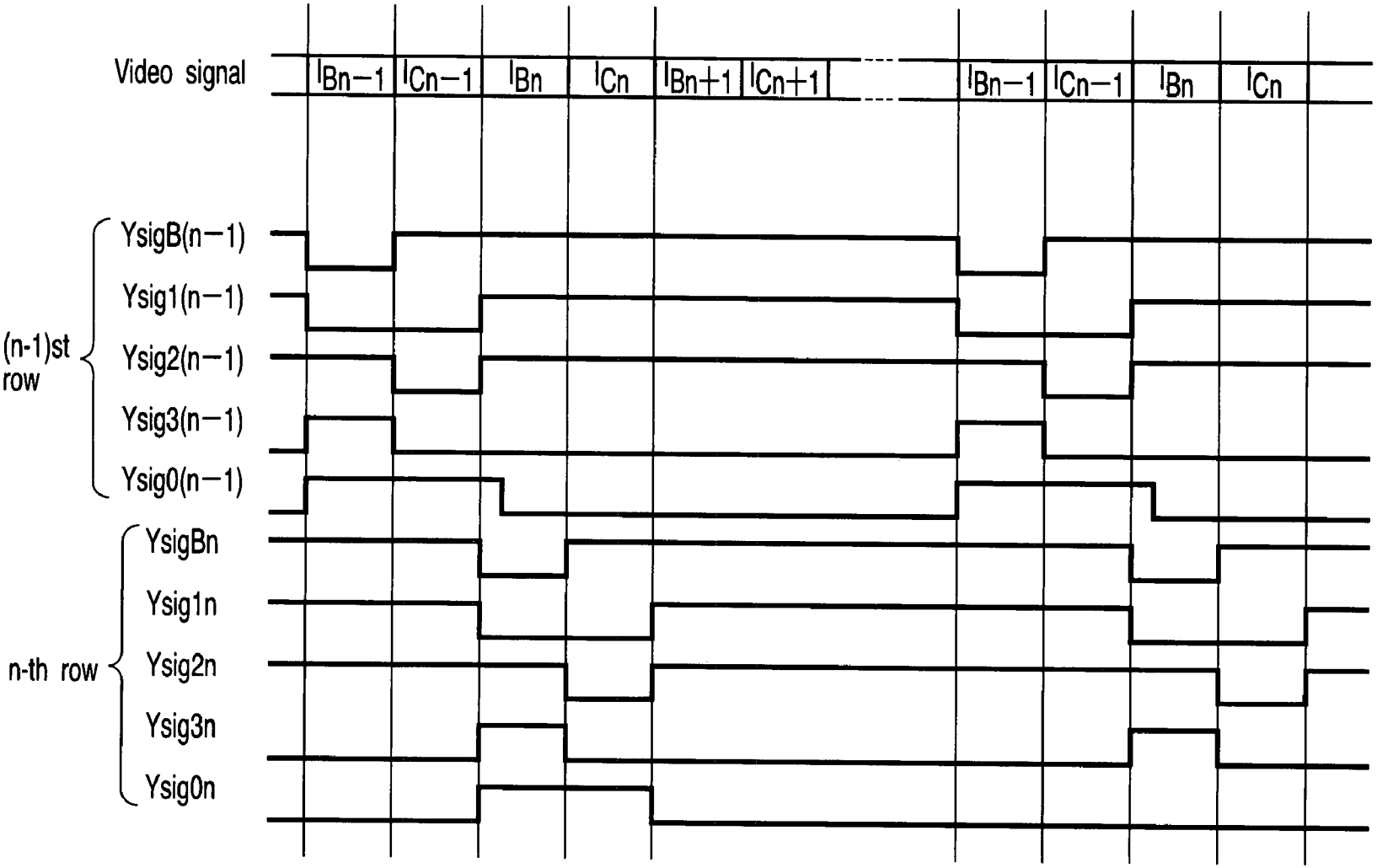
FIG. 28 is a timing chart of the organic EL display device of the sixth embodiment.

FIG. 26 shows one pixel 100 in the sixth embodiment and FIG. 27 shows its equivalent circuit. FIG. 28 shows a timing chart at each part. The base current storage unit 200 is written with a base current each time the pixel 100 is rewritten, that is, with each horizontal period. A store operation is performed for each base current storage unit 200. Each base current storage unit 200 has its stored contents refreshed with each vertical period.

Thus, the placement of the base current storage unit 200 in each pixel 100 allows display nonuniformity, particularly in video signal line units in a display surface, to be reduced. At the same time, the response can be improved and the write period can be shortened.

In the third through sixth embodiments, the other arrangements remain unchanged from the second embodiment. Corresponding parts are denoted by like reference numerals and detailed descriptions thereof are omitted.

The present invention is not limited to the embodiments described above. At the stage of practice of the invention, constituent elements can be embodied in modified forms without departing from the scope and spirit thereof. The constituent elements disclosed in the embodiments can be combined appropriately to form various inventions. For example, some elements may be removed from all the constituent elements shown in the embodiments. In addition, the constituent elements in different embodiments may be combined appropriately.

What is claimed is:

1. An active matrix display device comprising:

a plurality of pixels arranged in the form of a matrix on a substrate, each of the pixels including a display element and a pixel circuit which supplies the display element with a drive current;

a plurality of first video signal lines and a plurality of second video signal lines arranged along the pixels; and a video signal driver which supplies the pixels with base currents through the first video signal lines and with gradation currents through the second video signal lines, the gradation currents being opposite in the direction of flow to the base currents, the pixel circuit including a first pixel switch connected to a corresponding one of the first video signal lines and a second pixel switch connected to a corresponding one of the second video signal lines, the pixel circuit being configured to store the difference current between the gradation current and the base current when the pixel is selected, and output the stored difference current as the drive current when the pixel is nonselected.

2. The active matrix display device according to claim 1, wherein the base current is set to a value greater than a displacement current required to charge a potential difference between the highest gradation display time and the lowest gradation display time.

3. The active matrix display device according to claim 1, wherein the video signal driver is formed on the substrate.

4. The active matrix display device according to claim 1, wherein the display element is a self-emission element having an organic light emission layer between opposed electrodes.

5. The active matrix display device according to claim 1, further comprising a scan driver which outputs control signals for on-off control of the first and second pixel switches, the scan driver being formed on the substrate.

6. The active matrix display device according to claim 1, wherein each of the pixel circuit is provided with thin-film transistors using semiconductor layers formed of polysilicon.

7. An active matrix display device comprising:

a plurality of display elements arranged in the form of a matrix on a substrate;

first and second video signal lines which supply each of the display elements with video signals;

a capacitor which holds the video signal for a predetermined period;

a transistor having its gate connected to one end of the capacitor and its source connected to the other end of the capacitor;

a first switch connected between the gate and drain of the transistor;

a first pixel switch connected between the first video signal line and the drain; and a second pixel switch connected between the second video signal line and the drain.

8. An active matrix display device comprising:

a plurality of pixels arranged in the form of a matrix on a substrate, each of the pixels including a display element and a pixel circuit which supplies the display element with a drive current;

video signal lines arranged along the pixels; and a video signal driver which, after the supply of base currents to the video signal lines, supplies the pixels with gradation currents through the video signal lines, the pixel circuit including a pixel switch which controls whether or not to select the pixel, the pixel circuit being configured to store the difference current between the gradation current and the base current when the pixel is selected, and output the stored difference current to the display element as the drive current when the pixel is nonselected.

9. The active matrix display device according to claim 8, wherein the base current, in a horizontal scanning period, is set to such a value that a line capacitance of the video signal line becomes greater than the amount of charge corresponding to a potential change from the highest gradation display to the lowest gradation display.

10. The active matrix display device according to claim 8, wherein the video signal driver is formed on the substrate.

11. The active matrix display device according to claim 8, wherein the display element is a self-emission element having an organic light emission layer between opposed electrodes.

12. The active matrix display device according to claim 8, further comprising a scan driver which outputs control signals for on-off control of the pixel switches, the scan driver being formed on the substrate.

13. The active matrix display device according to claim 8, wherein each of the pixel circuits is provided with thin-film transistors using semiconductor layers formed of polysilicon.

14. An active matrix display device comprising:

a plurality of pixels arranged in the form of a matrix on a substrate, each of the pixels including a display element and a pixel circuit which supplies the display element with a drive current;

video signal lines arranged along the pixels;

a video signal driver which supplies base currents to the video signal lines and supplies the pixels with gradation currents through the video signal lines; and a base current storage unit which stores the base currents supplied from the video signal driver and outputs them to the video signal lines, the pixel circuit including a pixel switch which controls whether or not to select the pixel, the pixel circuit being configured to store the difference current between the gradation and base currents when the pixel is selected, and output the stored difference current as the drive current when the pixel is nonselected.

15. The active matrix display device according to claim 14, wherein the base current storage unit is provided for each pixel.

16. The active matrix display device according to claim 14, wherein the base current storage unit is provided for each video signal line.

17. The active matrix display device according to claim 14, wherein the base current storage unit is connected in common to the video signal lines and connected to a different video signal line at each predetermined period.

* * * * *